US005458209A

United States Patent [19]

Hayes et al.

[11] Patent Number: 5,458,209

[45] Date of Patent: Oct. 17, 1995

[54] DEVICE, SYSTEM AND METHOD FOR DRILLING AND COMPLETING A LATERAL WELL

[75] Inventors: Lew Hayes, Calgary; Larry Comeau, Leduc, both of Canada; Christian Wittrisch, Rueil Malmaison, France; Ray Smith, Beaumont, Canada

[73] Assignee: Institut Francais du Petrole, Rueil Malmaisson, France

[21] Appl. No.: 74,475

[22] Filed: Jun. 11, 1993

[30] Foreign Application Priority Data

Jun. 12, 1992 [FR] France ..... 92 07142
Jan. 8, 1993 [FR] France ..... 93 00154

[51] Int. Cl.[6] ..... E21B 7/08

[52] U.S. Cl. ..... 175/61; 166/117.5; 175/79; 175/81

[58] Field of Search ..... 166/117.5, 117.6, 166/242, 317, 376; 175/61, 78, 79, 80, 81

[56] References Cited

U.S. PATENT DOCUMENTS

| | | | |
|---|---|---|---|
| 2,797,893 | 7/1957 | McCune et al. | 166/117.5 X |
| 2,804,926 | 9/1957 | Zublin | 166/50 |
| 3,215,204 | 11/1965 | Sims | 166/117.5 |
| 4,396,075 | 8/1983 | Wood et al. | 175/79 |
| 4,402,551 | 9/1983 | Wood et al. | 299/5 |
| 4,415,205 | 11/1983 | Rehm et al. | 299/5 |
| 4,444,276 | 4/1984 | Peterson, Jr. | 175/61 |
| 4,519,463 | 5/1985 | Schuh | 175/61 |
| 4,573,541 | 3/1986 | Josse et al. | 175/78 |
| 4,605,076 | 8/1986 | Goodhart | 175/61 |
| 4,693,327 | 9/1987 | Dickinson et al. | 175/61 |
| 4,699,224 | 10/1987 | Burton | 175/61 |
| 4,807,704 | 2/1989 | Hsu et al. | 166/313 |
| 4,852,666 | 8/1989 | Brunet et al. | 175/61 |
| 5,012,877 | 5/1991 | Winters et al. | 175/80 |
| 5,115,872 | 5/1992 | Brunet et al. | 175/61 |
| 5,311,936 | 5/1994 | McNair et al. | 166/50 |
| 5,318,121 | 6/1994 | Brockman et al. | 166/313 |
| 5,318,122 | 6/1994 | Murray et al. | 166/313 |
| 5,322,127 | 6/1994 | McNair et al. | 166/313 |
| 5,325,924 | 7/1994 | Bangert et al. | 166/313 |

FOREIGN PATENT DOCUMENTS

| | | |
|---|---|---|
| 3832715 | 3/1990 | Germany . |
| 81/00017 | 1/1981 | WIPO . |

*Primary Examiner*—David J. Bagnell
*Attorney, Agent, or Firm*—Antonelli, Terry, Stout & Kraus

[57] ABSTRACT

A method and system for lateral drilling with respect to a main well which is cased by a casing string. At least a part of the casing string provides a lateral opening adapted to enable drilling of a lateral well. A guiding device is positioned at a part of the casing string in front of the lateral opening and the guiding device is controlled from the surface of the main well. A lateral casing string equips the lateral well and provided a sub for connecting the lateral casing string to the main string in the main well.

61 Claims, 15 Drawing Sheets

25
24
23
D
55
29
27
21
28
16
17
12
66
26
4C
30
34
33
31
35
75
32

25
24
23
135
27
134
28
16
12
17
66
26

23
135
138
137
27
136
21
134
17
16
140

34
143
33
35
142
75
143
12

DEVICE, SYSTEM AND METHOD FOR DRILLING AND COMPLETING A LATERAL WELL

FIELD OF THE INVENTION

The present invention details a system which is adapted to drill and complete a lateral well with respect to a main well. The main well may exhibit any inclination and may notably be substantially vertical or strongly inclined.

BACKGROUND OF THE INVENTION

The technique consisting of laterally drilling from a previously drilled main well is not a new form of technology. This main well may be an open hole well, that is to say uncased, or cased by a casing string. In the first case, the well generally has to be plugged at the depth at which point the lateral drilling is to be initiated. This may be achieved by setting a cement plug which will provide the support necessary for a directional drill string to begin lateral drilling. This drill string is conventionally equipped with a downhole motor and a deflection tool, such as a bent sub. It is also possible to perform a rotary drilling operation by using a deflection device commonly called a "whipstock", which is fastened to, or fixed in place of the plug. This latter technique, which is quite old, is more difficult to master in open holes where it is difficult to correctly position the whipstock in the well. If the main well is already cased, the technique, which is identical, imposes an additional operation involving the milling of a window in the casing in order to utilize a directional drill string through the opening provided thereby. This operation requires a milling tool adapted to the material of the casing in which a window is to be cut out.

The object of these procedures, known as "side track" operations, is generally to abandon the lower part of the main well located at a lower level than said the plug or "whipstock". In this case, the completion of the new Well will be conventional, that is to say, the casing is either run to surface or is suspended in an existing string through well-known means, for example by use of the hanging device commonly known as a "liner hanger".

U.S. Pat. No. 4,807,704 mentions a known system and method for completing several laterals from a main well, but the equipment of the main and of the lateral well is complex and restricts the inner space of the main well, making any access to the lower part of the main well impossible. Moreover, drilling the lateral well requires a stage of milling in the casing string of the main well.

U.S. Pat. No. 4,852,666 mentions a known device and method for drilling lateral wells with respect to a horizontal drain. However, this document does not disclose a technique allowing lateral wells to be drilled from a main well which is already cased. Besides, it does not allow the lateral well to be completed with a casing.

SUMMARY OF THE INVENTION

The present invention concerns a connecting device for linking two casing elements together, wherein a first casing element has a lateral opening of a dimension adapted to allow passage of a second casing element and the second casing element extends laterally from the first casing element after passage through the first casing element, with the device comprising a tie-in means for linking the second casing element to the first casing element located on the periphery of the first casing element.

It is another object of the invention to provide a system for drilling and completing at least one lateral well with respect to a main well cased by a main casing string comprising at least one lateral opening, with the opening being adapted to allow the passage of a drilling tool, the system comprising a lateral casing string arranged in the lateral well, guide means positioned in the main casing string adjacent to said opening, and means for effecting a tie-in of the lateral casing string to the main casing sting located substantially on a periphery of the main casing string.

Yet, another object of the invention is a system for drilling and completing a well extending laterally with respect to a main well, with the system comprising a casing string in the main well, said string having at least one tubular portion equipped with a lateral opening and means for at least partially closing the opening.

The invention also concerns a method for drilling and completing lateral wells from a main well cased by a casing string comprising at least one lateral opening, with the method comprising the steps of positioning, in the casing string, guide means substantially at the level of the at least one lateral opening, introducing lateral drilling means through the at least one lateral opening via the guide means to drill a lateral well extending from the main well, providing the lateral well with a lateral casing string, and connecting the lateral casing string substantially on a periphery of the casing string.

It is another object of the invention to provide a method for drilling and completing lateral wells from the main well cased by a casing string comprising the steps of fitting the main well with a casing string having at least one tubular portion comprising at least one lateral opening, orienting the direction of the at least one lateral opening by applying the rotation to the casing string from the surface, and controlling the direction of the at least one opening by a measuring tool.

Thus, the object of the present invention is notably to case a main well with a casing string comprising one or several lateral openings, which would be at least partly prepared before the casing operation, then to hang therein a lateral string introduced into a lateral well drilled from one of the openings.

When the casing string includes tubular elements assembled as it is introduced into the well, tubular elements that are specifically manufactured, notably comprising a lateral opening, are used. A conventional casing operation is achieved but while placing, at the desired position, the specific elements comprising the lateral opening, as well as other drilling and completion devices. The main well is thus equipped With a mixed casing comprising, at the locations predetermined by the operators, the lateral drilling and completion devices ready for use.

When the main well is equipped in this fashion, it should be noted that the access to the inner space of the casing will still allow servicing operations which the man skilled in the art may wish to carry out in such a well. In fact, the inner space of the casing prepared according to the present invention will allow passage of tools. It is thus possible to have access to the inner part of the casing, below the lateral drilling zone, with tools which have a conventional maximum outside diameter with respect to the inside diameter of the main casing. The drilling and the completion of the lateral drains distributed over the length of the main casing may thus be achieved with tools and equipment of equal dimension since substantially no obstacle obstructs the inner passageway of the main casing.

Moreover, if developing the reservoir, considered from the main casing alone, appears to be interesting, appropriate operations of bringing into production may be started conventionally, for example, by setting a tubing or a pumping installation. Communication between the producing formation and the inside of the casing must of course exist. This is the case if the casing is not cemented and if it comprises at least one perforated pipe portion. In the opposite case, the in-situ perforation means which are well-known in the an are used.

The method for completing the main well according to the invention shows great flexibility in its use, since several production stages can be planned:

First, the main well can be put on production alone in a typical fashion using conventional production, bringing in or measuring procedures since there are no obstructions in the casing.

This may be done until the appropriate or the inevitable time at which new investments must be made in order to maintain an economically acceptable production level.

One or several lateral wells may then be drilled by using the specific equipment installed with the casing, by using the production data acquired during a previous stage.

This production scheme is one example of many possibilities which can be achieved with the present invention.

This process is possible because the initial investment, corresponding to the specific string of the main well, does not represent any high additional costs. The drainage of the well may be improved thereby.

Besides, in the present invention, the openings may be sealed prior to being run in the wellbore. This will allow completion of a conventional cementing operation.

To achieve this seal, it will be advantageous to use bands, notably made of thermosetting composite material which may comprise reinforcing fibers embedded in a matrix. A part made of aluminum or any other drillable material may be placed on the opening so that its sealing through the bands may withstand higher pressures. A drill bit of a conventional type, used for lateral drilling, can drill through these bands and their reinforcements without imposing any additional operation. Drilling can thus be carried on after drilling through the band, without changing the tool.

Thus, when at least one lateral well is to be drilled, a preferred method according to the invention may procede in the following stages. The stages described hereunder should begin at the point where a casing comprising at least one specific opening has been installed in the main well. Guide means comprising a guiding ramp similar to that of a whipstock are taken down into the main casing, by means of maneuvering rods, such as drillstring or drillpipe. The guide means are advantageously designed to allow complete flexibility for their placement close to any one of the lateral openings, when there are several of them. The operator may thus choose any opening of the casing to carry out the lateral drilling and improve the production.

The guide means, anchored and oriented with respect to the opening, may be used both as a deflection tool for the drill bit, and as a means for positioning the casing string installed in the lateral well.

To carry out the drilling operation, the maneuvering rods are withdrawn so as to take down the lateral drill string. The drill string is conventionally that which is used by operators with a deflection tool such as a whipstock, that is to say notably comprising a drill bit, a downhole motor, drill collars, drillpipe.

When the lateral drilling is completed, the operator can decide whether or not to equip the lateral well with a casing which some portions of it could be blank, perforated or not. If the completion is achieved after drilling, as it is often the case, in order to limit the risks of bridging the well through a sloughing of the formation, the same guide means are preferably used to guide the lateral casing string into the lateral well. The upper end of the lateral casing and the opening comprise means for ensuring the tie-in of the lateral casing to the main casing at the level of the opening. These tie-in means may comprise a connecting sub adapted to co-operate with the opening. This sub is fastened to the upper end of the lateral casing.

The invention is notably advantageous in that it does not inhibit large restriction of the inner space of the main casing through the tie-in means between the lateral casing and the main casing, which allows access to the other openings located further from the surface, even after completion of the lateral well with the lateral casing.

Besides, closing means, for example a sliding gate, may complete the tie-in means.

This gate is adapted for practically obstructing the total space between the connecting sub of the lateral casing and the opening, so that the effluent coming from the lateral well flows into the main casing through the inside of the lateral casing and not through the annular space between the well and the casing. In fact, if this were not the case, installing a string in the lateral well would be questionable.

The purpose of the gate may also be to hold the connecting sub on the casing of the main well through the co-operation of fastening or tie-in means integrated to the sub with the gate.

The purpose of the running tool for setting the lateral casing may advantageously be to properly position the special sub with respect to the opening and to close the gate. These two operations may of course be achieved with different tools.

BRIEF DESCRIPTION OF THE DRAWINGS

Other features and advantages of the invention will be clear from reading the description hereafter, with reference to the accompanying drawings in which.

DESCRIPTION OF THE PREFERRED EMBODIMENTS

Figure 1:
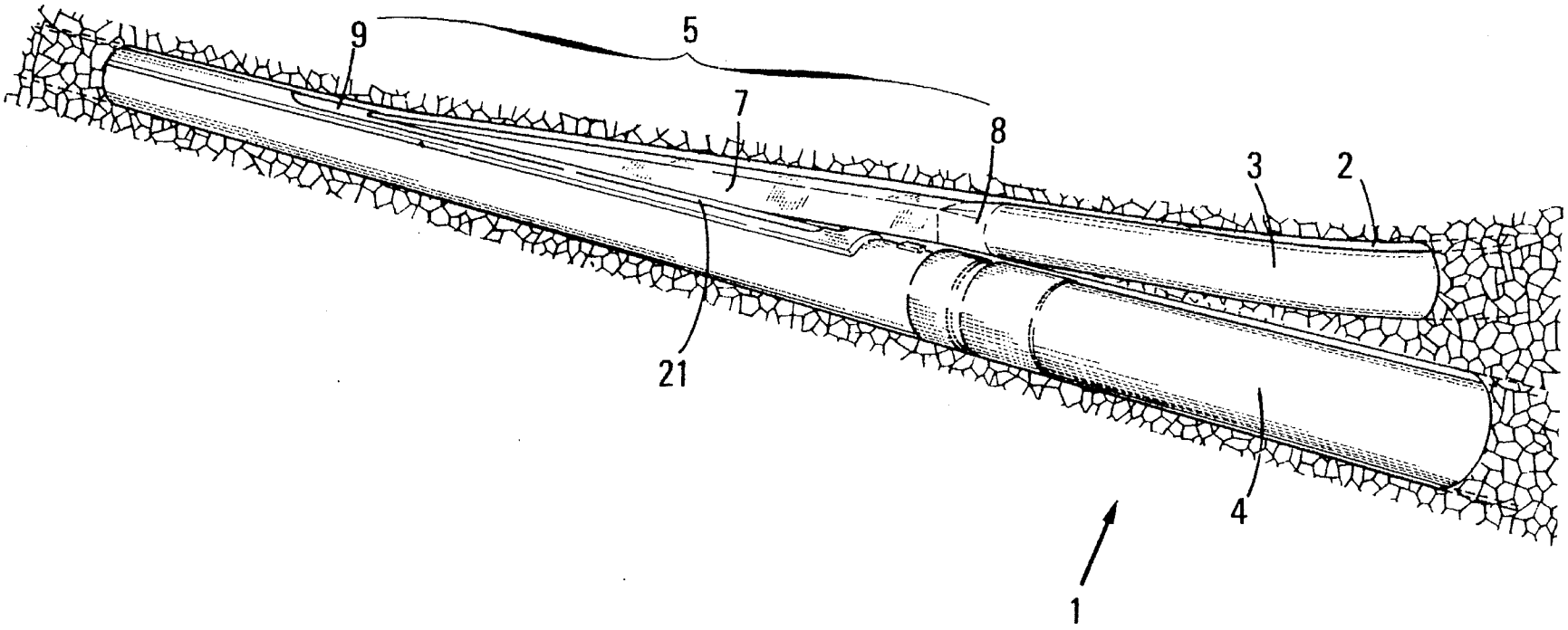
FIG. 1 schematically illustrates a main well and a lateral well equipped with casing sting.

In FIG. 1, a main well 1 and a lateral well 2 respectively having casing strings 4, 3 installed therein. An assembly 5 mainly comprises a lateral opening 21 in the casing string 4, a connecting sub 7, between the main string 4 and the lateral string 3, an intermediate joint 8 between the connecting sub 7 and the casing string 3, means 9 for closing a space between the connecting sub 7 and the opening 21. The details, as well as other components, will be discussed more fully hereinbelow in connection with the accompanying drawings.

Figures 2A, 2B:
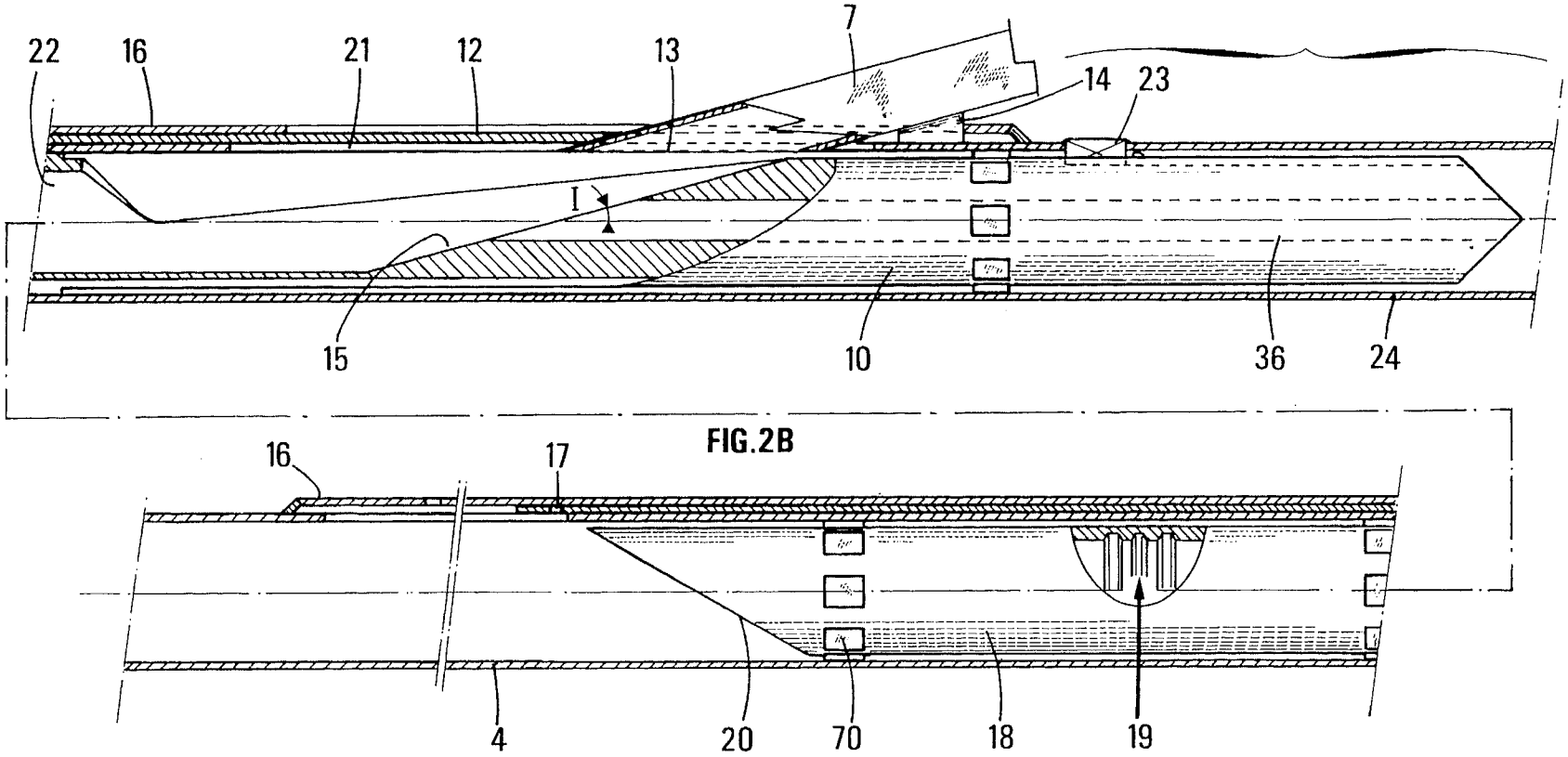
FIGS. 2A and 2B are fragmentary cross-sectional views of the tabular portion of the main string comprising at least one lateral opening, the guiding device and the sub for connecting the lateral string.

FIGS. 2A and 2B illustrate a fragmentary cross-section of the main string 4 in which the guide means 10 are positioned, detailing how the system should be laid out for the operation of drilling or for completion of the lateral well. Connecting sub 7 is shown in FIG. 2A fastened through stop motion and hold-back means 14, and a sliding gate 12 closes the lateral opening 21 around the connecting sub 7. Details of the gate 12 and of the opening 21 will be described more fully herein below in connection with FIGS. 4A, 4B, 4C, 4D or 15A, 15B and 15C.

It should be noted, in FIG. 2A, that the end 13 of the connecting sub 7 does not intrude inside the casing string 4 and lies substantially in the same plane as the opening 21. Details of the connecting sub will be described more fully hereinbelow in connection with FIGS. 6A, 6B, 6C, 6D and 6E.

The gate 12 is held on the casing string 4 by a housing or cap 16. A shear pin 17 fastens the gate 12 in an upper or open position, a position in which the opening 12 has a dimension which allows the drill bit and the lateral casing string 3 to pass through. In FIGS. 2B and 2A, the shear pin 17 is sheared and the gate 12 is in the closed position on opening 21, around the connecting sub 7.

Figure 5B:
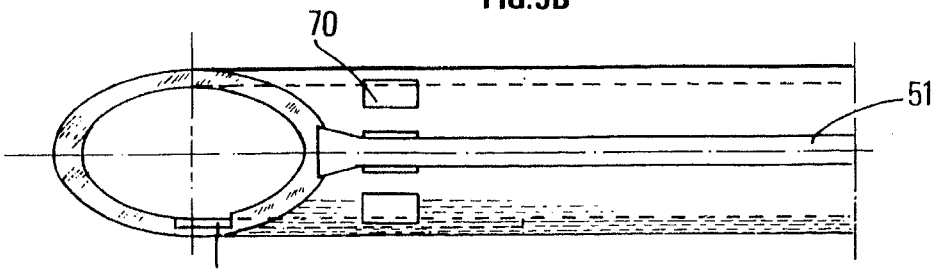
FIGS. 5A and 5B illustrate an upper end of the guiding device of the present invention.
Figure 5A:
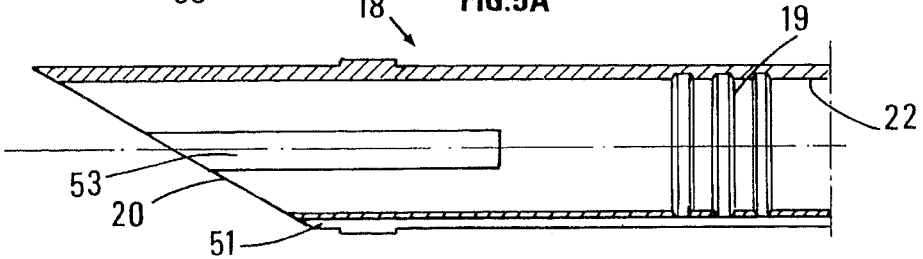

As shown most clearly in FIGS. 3A–3D, the guide means are comprised of three main parts; namely, a lower end 11, detailed in FIGS. 3A, 3B, 3C, 3D and 3E; a central part comprising a ramp (FIG. 2A) whose face is oriented toward the opening 21. An angle I (FIG. 2A), formed by the ramp 15 with respect to the longitudinal axis, is preferably equal to or ranges between 1° and 5°, although the value of the angle formed by the ramp 15 is not limitative of the scope of the present invention, particularly, the ramp 15 can be made progressive through angles of slope increasing from 1° to 5°; and an upper end (FIG. 2B) comprising a preferably cylindrical inner passageway 22 (FIG. 2A), allowing entry of the lateral drill bit as well as the casing string 3 completing the lateral well, means 19 for hanging the tool for maneuvering the guide means 10, orienting means for allowing both the guide means 10 to be taken up in the direction of the surface without being stuck by the key 23 integral with the casing string 4, and the connecting sub 7 to be oriented with respect to the ram 15. FIGS. 5A and 5B more fully describe the various components.

A channel or conduit 36 (FIGS. 2A, 3B, 3E, 3D), provided in the guide means 10, communicates the inner space of the casing string 4 on either side of the guide means 10. Centering parts 70 (FIGS. 2B, 3D, 5B) are arranged on the circumference of the guide means 10, specifically at the level of the lower end 11 and the upper end 18.

Figures 4A, 4B, 4C, 4D:
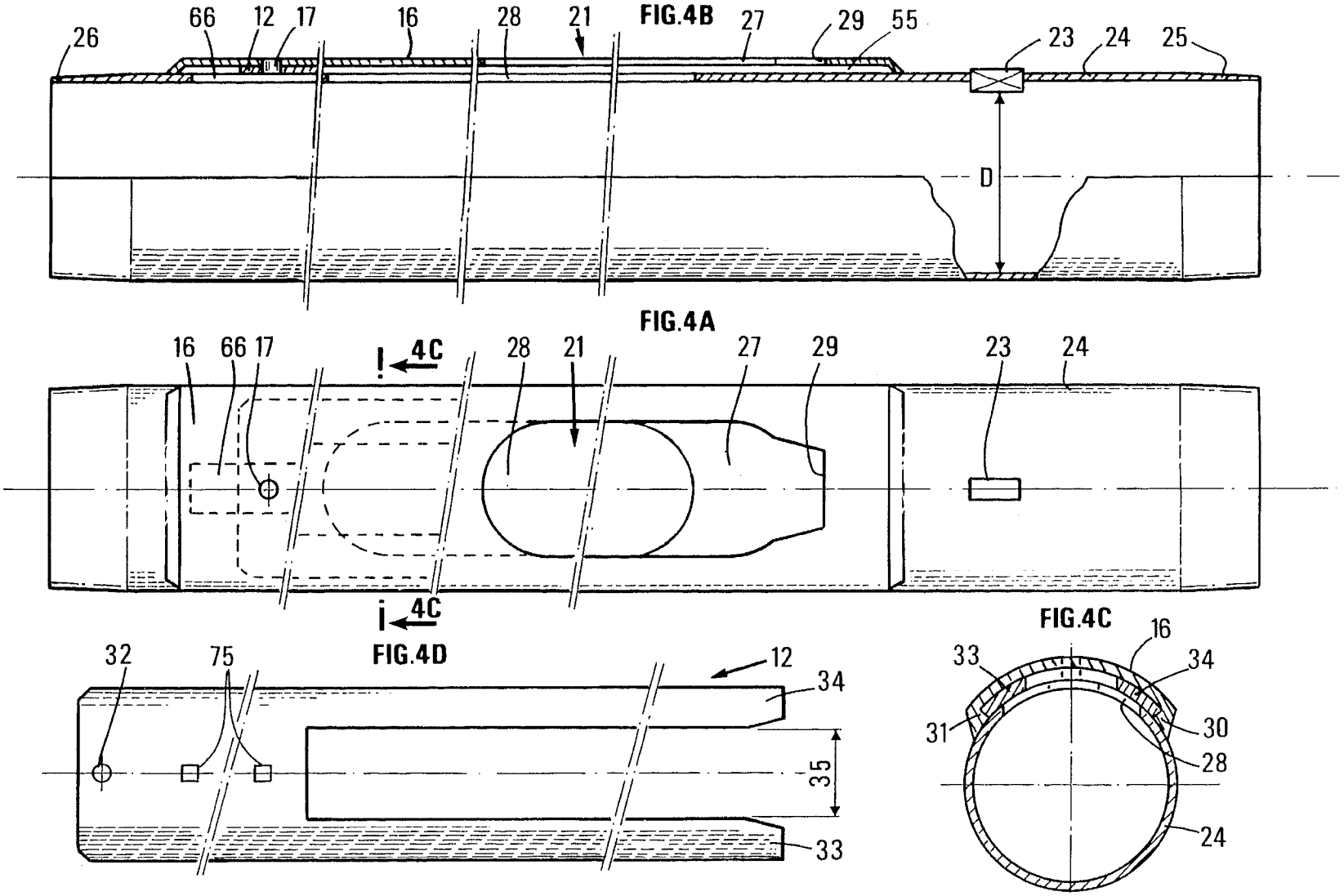
FIGS. 4A, 4B and 4C are views of a tubular portion comprising the at least one lateral opening.
FIG. 4D illustrates a sealing gate around the connecting sub.

FIG. 4A shows a top view of a tubular element 24 intended to be assembled with other tubes to form the casing string 4. The assembling is achieved by threads 25 and 26 (FIG. 4B). Opening 21 actually includes two windows 27 and 28, respectively cut out in the housing or cap 16 and the tubular body of the tubular element 24. The purpose of the cap 16 is to maintain and guide the sliding gate 12 shown in top view in FIG. 4D.

The width of the opening 21 is adapted to permit a lateral drill bit to pass through, with the length of the opening 21 depending upon the slope of the ramp 15. The planar surface 29, which is part of a periphery of the window 27 of the cap 16, is the place where the connecting sub 7 lands and is fixed in place.

A key 23 is welded on the body of the tubular element 24, preferably, along the longitudinal axis of the opening 21. The key 23 sticks out of the inner wall of the tubular element 24 so that the top of the flat part of the key 23 is located at a distance D from the diametrically opposite point. The value for the distance D is functionally significant for the positioning of the guiding means 10, this function being assigned to the key 23, which is integral with the tubular element 24. Besides, this value for the distance D is sufficient not to hinder passage of a servicing part. Gate 12 is fixed in an open position by shear pin 17 and, in this position, the opening 21 has maximum dimensions.

FIG. 4C is a cross-section of the tubular element 24 which shows the configuration of the gate 12 on the body of the tubular element 24 and the assembling of the cap 16 on this body through the welding of two rods 30, 31 over the total length. The greatest outer diametral dimensions of the tubular element 24 will, preferably, not be larger than an outside diameter of a collar of the couplings of the pipes forming the casing string 4. Thus, the tubular element 24 may be lowered into a borehole drilled by a tool of conventional diameter, without causing frictions higher than those created by a pipe coupling.

FIG. 4D is a view of the plate constituting the gate 12. Bore 32 receives the shear pin 17. The branches 33, 34 separated by a distance 35 will substantially close the clearance between the opening 21 and the connecting sub 7. The U-shape and width of the distance 35 depends upon the outer shape of the connecting sub 7. It should be noted that the U-shape of the window in the gate 12, when the gate 12 is closed, cooperates with the planar surface 29 forming a periphery of the window 27 of the cap 16, so as to form a rectangle of substantially equal dimensions with the section of the end of the connecting sub 7. In fact, referring to FIGS. 6A, 6B, 6C, 6D and 6E, which diagrammatically show the connecting sub of a square cross section, it may be seen that the section 13 (FIG. 6A) of the end of the connecting sub 7 has a rectangular shape corresponding to the U-shape opening of the gate 12 and to the width of the planar surface 29 forming the periphery of the window 27. In the case of a section of different shape for the connecting sub 7, the gate 12 and the peripheral portion of the opening 21 will be adapted so as to leave a limited space or even no space between the connecting sub 7 and the tubular element 24 once the gate 12 is closed on the connecting sub 7. The purpose of the cooperation of the gate 12 with the connecting sub 7 is to provide a seal sufficient to prevent fluid from flowing around the connecting sub 7. Within the scope of this invention, a resilient joint may be added either on the connecting sub 7 or on the gate 12 and the planar surface 29, or on both, so as to improve the effect of the seal.

Figure 10A:
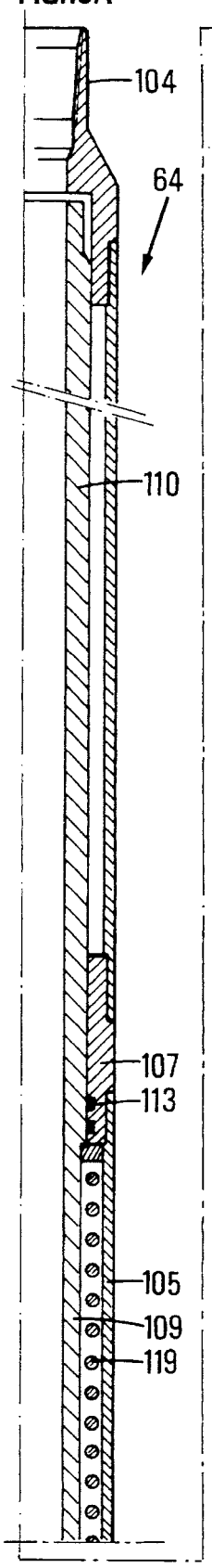
FIGS. 10A, 10B and 10C are cross-sectional views of a device for closing a gate.
Figure 10B:
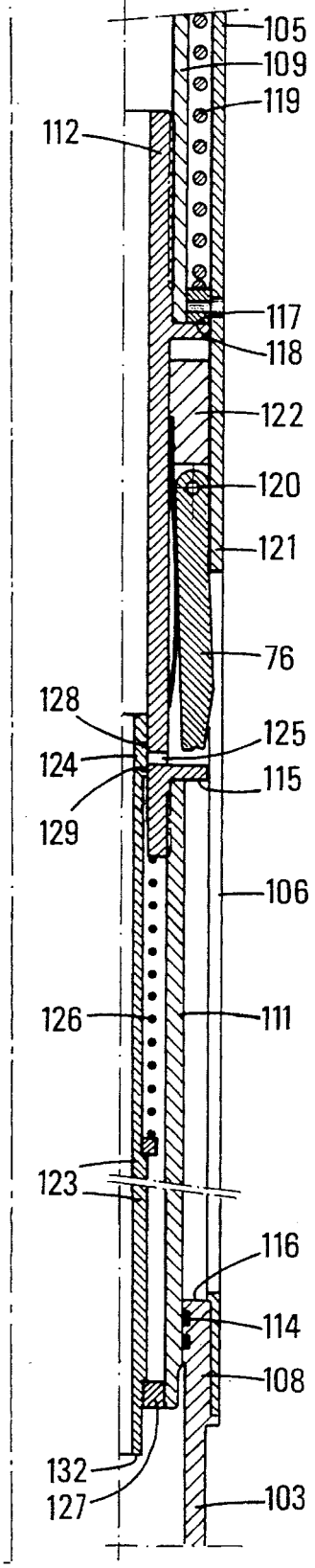
Figure 10C:
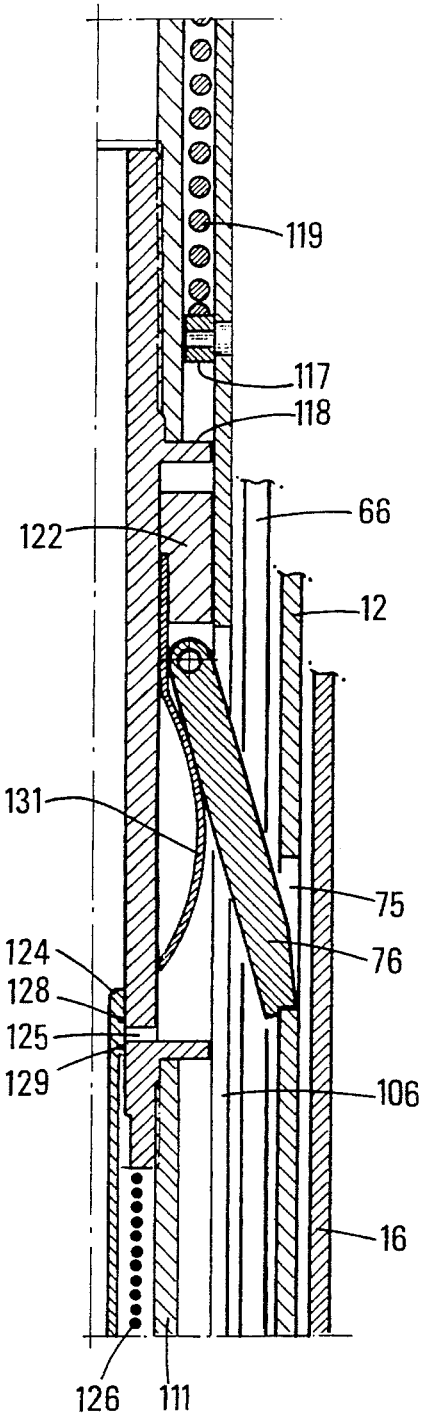

Bores 75 (FIG. 4D) are machined in the gate 12. The shape of the bores 75 is adapted for cooperation with a means for displacing the gates 12, with this displacing means being part of the running tool. The finger 76 of the running tool, shown in FIGS. 10A, 10B and 10C, illustrate, for example, this displacing. According to the length of the displacement of the gate 12 and of the translation displacement of the finger 76 (FIGS. 10B, 10A), several bores 75 are necessary and spaced out at most by a length of the displacement of the finger 76. Bores 75 must fit a slot 66 of the body of the tubular element 24 so as to allow the gate 12 to be actuated from the inside of the casing string 4, through the wall of the tubular element 24.

Figures 15A, 15B, 15C:
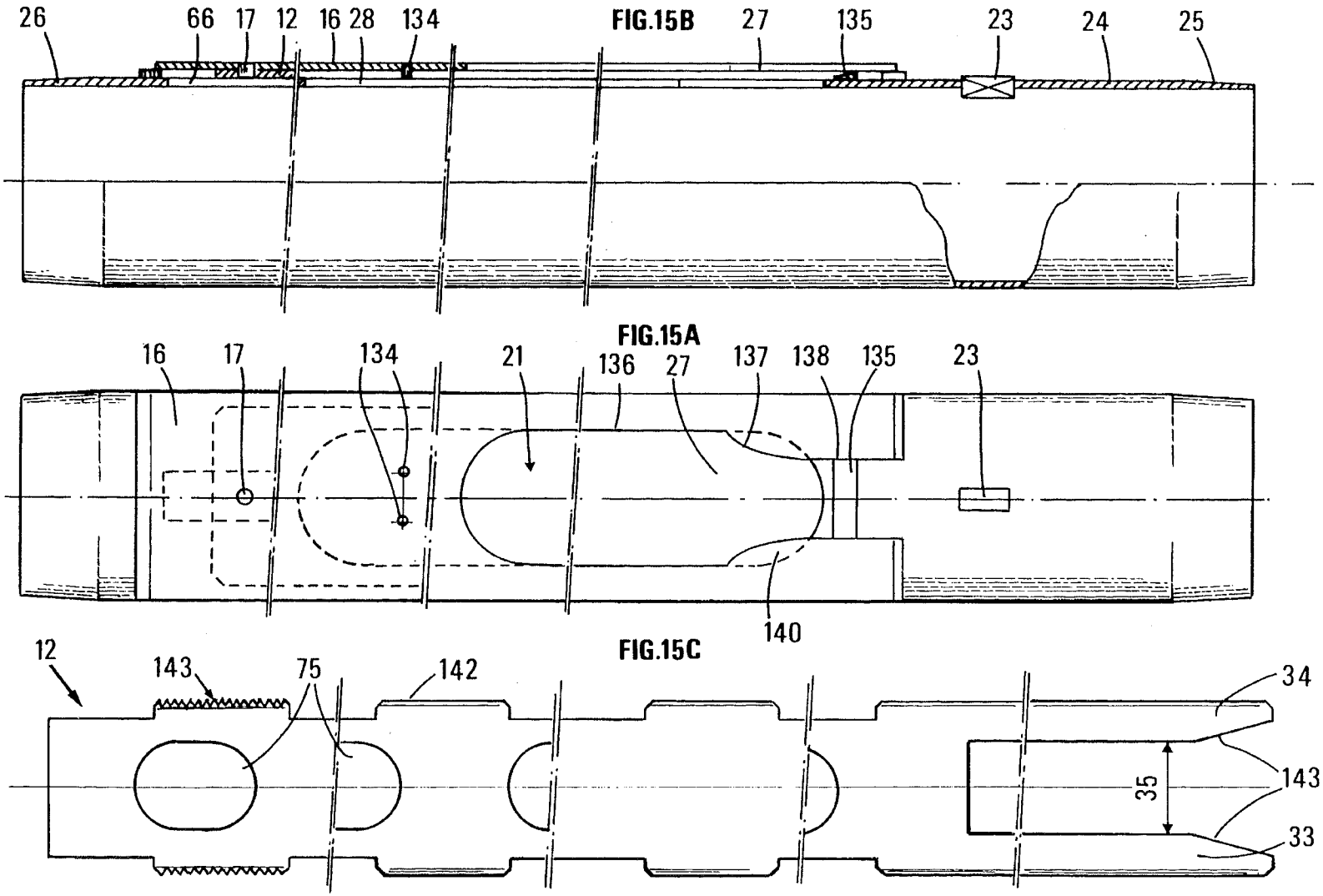
FIGS. 15A, 15B and 15C are schematic views of a preferred embodiment of the tubular part comprising an opening and the gate.

FIGS. 15A, 15B and 15C show another embodiment of a tubular element 24 and another design of the gate 12. With respect to FIGS. 4A and 4B, FIGS. 15A and 15B mainly differ in the shape of the first and second windows 27 and 28, respectively, in the cap 16 and the tubular element 24, with the coincidence of the windows 27, 28 defining the opening 21. The wide part 136 of the window 27 narrows in the shape of a funnel and eventually has, at 138, substantially the width of the connecting sub 7. Thus, wings 139 of the connecting sub 7 (FIGS. 6C, 6D) are locked by the cap 16 substantially in the zones 140, below which the tubular element 24 is open by the opening 28. The section of the part 135 welded on the tubular element 24 has the shape of a tooth whose slope allows displacement of the connecting sub 7 in the direction of introduction into the lateral well, but it blocks displacement of the connecting sub 7 when the part 141 of the connecting sub 7 has reached its end position. FIG. 6C shows the cooperation of the part 135 with the part 141 linked to the connecting sub, and after the connecting sub 7 has been set with respect to the opening 21.

One or several shear pins 134 are fixed in the cap 16 between the branches 33 and 34 of the gate 12, the gate 12 being in an open position. A series of pins 134 may be arranged along the axis of the U-shaped portion of the gate 12. The purpose of the pins 134 is the following: when the means for closing the gate shear pin 17, the gate 12 is driven in translation until the bottom of the U-shaped portion of the gate 12 locks against the pins 134. The closing means then warn the surface of a blocking in translation by a rise in hydraulic pressure, if the means are activated hydraulically, or by an increase in mechanical stress (for example, torque), if they are activated mechanically. The operator thus knows that the gate 12 has been moved by the distance between the initial position of the gate 12 and the pins 134. By placing a succession of series of pins 134, the operator may deduce, from the surface, the position reached by the gate 12.

Of course, in order to follow the displacement of the gate 12 from the surface, it is also possible to connect the gate 12 to sensors whose information may be transmitted to the surface through conventional means.

FIG. 15C is a topview of a gate 12 comprising branches 33 and 34 separated by a distance 35. The end 200 of branches 33 and 34 has a pointed tip so as to facilitate guiding with respect to connecting sub 7. The gate is indented so as to form notches 142 favoring the sliding in translation of the gate 12. On one of the notches 142, teeth intended for locking the gate 12 in a closed position around the connecting sub 7 have been machined. Details of this lock are shown in FIG. 12.

Figure 12:
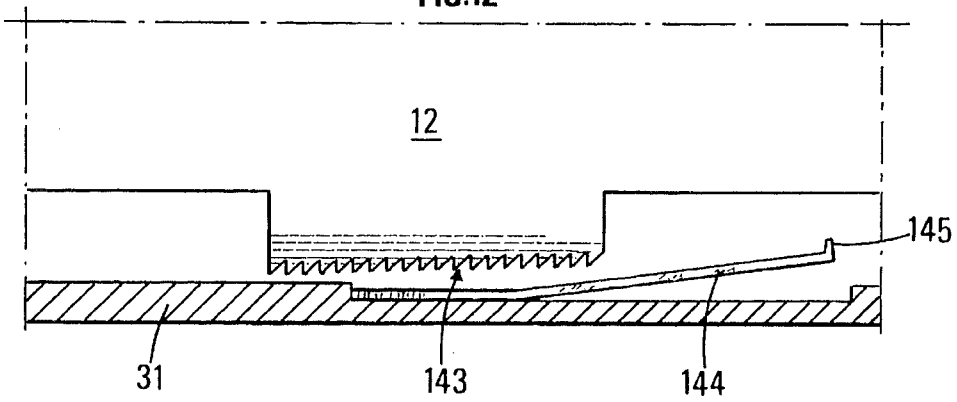
FIG. 12 is a cross-sectional view of a principle of a locking of the gate after closing.

FIG. 12 shows the principle of a locking of gate 12 in a closed position. A flexible leaf 144 is fixed on at least one of the rods 30 and 31 used for the lateral guiding of the gate 12 and for fastening the cap 16 on the tubular body 24. The end 145 of leaf 144 is suited for co-operating with teeth 143 when the gate 12 has been made to perform its total displacement. The dissymmetrical shape of the teeth 143 locks the gate 12 irreversibly once the end 145 of the leaf 144 is engaged in one of the teeth 143.

In FIG. 15C, bores 75, whose purpose is identical to those of FIG. 4D, have an oblong shape and a relatively large surface so as to admit a certain tolerance of positioning of the gate 12 with respect to the finger 76 of the means for displacing the gate, a well as a mechanical reinforcement of this finger.

Figure 3C:
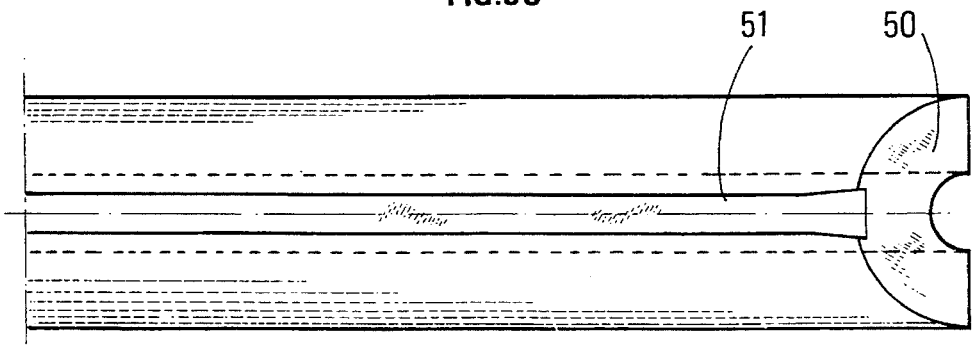
FIGS. 3A, 3B and 3C are views of a lower end of the guiding device.
Figure 3B:
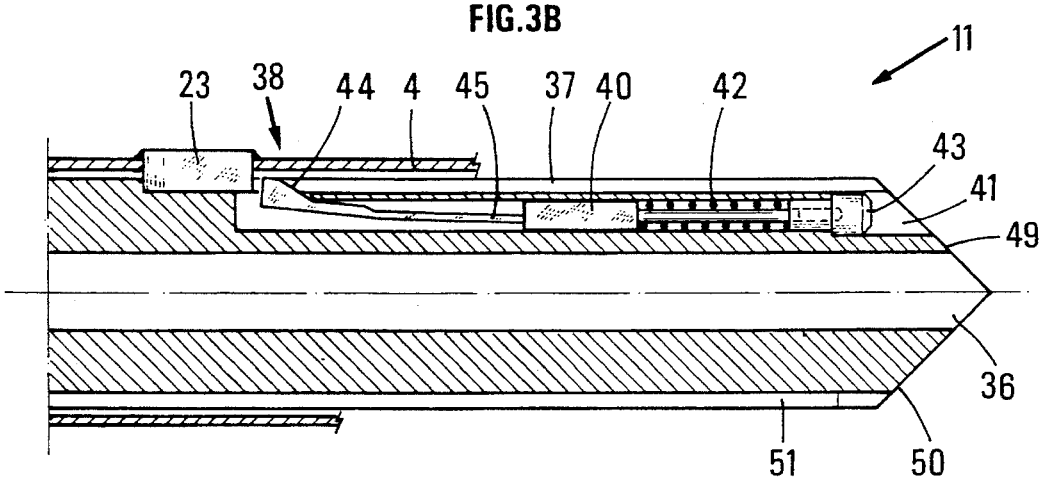
Figure 3A:
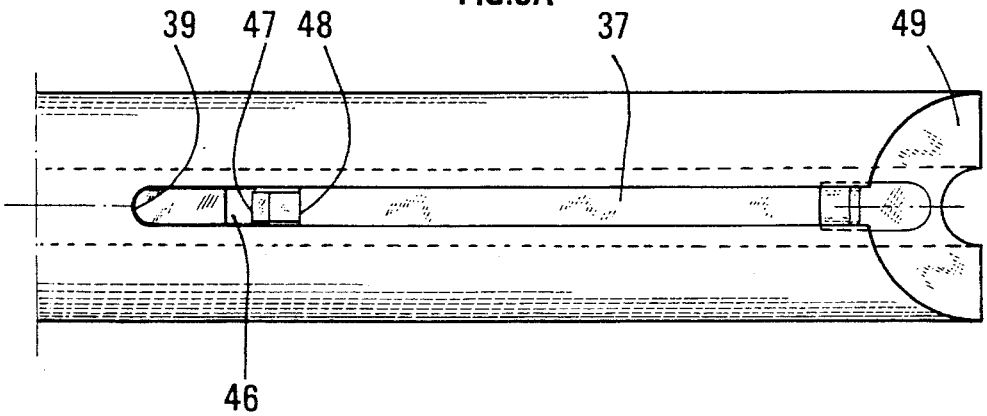

FIGS. 3A, 3B and 3C show in detail the end 11 of guide means 10. FIG. 3B is a cross-section of the means when they are positioned and anchored in pipe 4 through the cooperation of a key 23 and a groove 37. Groove 37 comprises a pawl 38 borne by a flexible leaf 45 integral with a slide valve 40 which can slide into the housing 41 parallel to, and arranged below, the groove 37. A return spring 42 of the slide valve 40 is held in housing 41 by a stopper 43. Pawl 38 has a slope 44 on the side opposite the bottom 39 of groove 37, with respect to the edge 47 defined hereafter. The flexibility of leaf 45 keeps pawl 38 prominent with respect to the bottom of the groove, through an opening 46 between housing 41 and groove 37. An edge or a bearing surface 47 of the pawl, mounted in this way, locks the key 23 in the housing defined by the bottom 39 of groove 37 and edge 47. When the operator exerts a tensile force on the guide means 10, sufficient for compressing spring 42, the edge 47 abuts the on key 23, an edge 48 of opening 46 co-operates with the slope 44 of the pawl so as to retract pawl 38 and releases the guide means 10 from the key 23.

Groove 37 has an open end. The open end, opposite the bottom 39 of groove 37, opens onto a plane surface 49 forming a face of the point of end 11. Another plane surface 50 forms the other side of the point. These two plane surfaces 49 and 50 belong to a dihedron. The point formed by surfaces 49 and 50 constitutes the means for orientation of the guide means 10 with respect to the key 23 which must, depending on the case, enter groove 37 or a groove 51 diametrically opposite to the groove 37. Groove 51 is provided over total length of a means 10 so that, when the key 23 is guided in the groove 51, the guide means 10 do not anchor and may be displaced either towards the bottom of the well, or towards the surface, while going from one side of the key 23 to the other.

The double bevelled shape of the end 11 of guide means 10, obtained through surfaces 49 and 50, is a preferred embodiment since it can be easily achieved. But only the periphery of surfaces 49 and 50 is functional since end 11 co-operates with key 23 for guiding and orienting. Ramps for guiding the key in the groove 37, or in the groove 51, may be achieved differently for equivalent results, without departing from the scope of the invention.

Figure 3E:
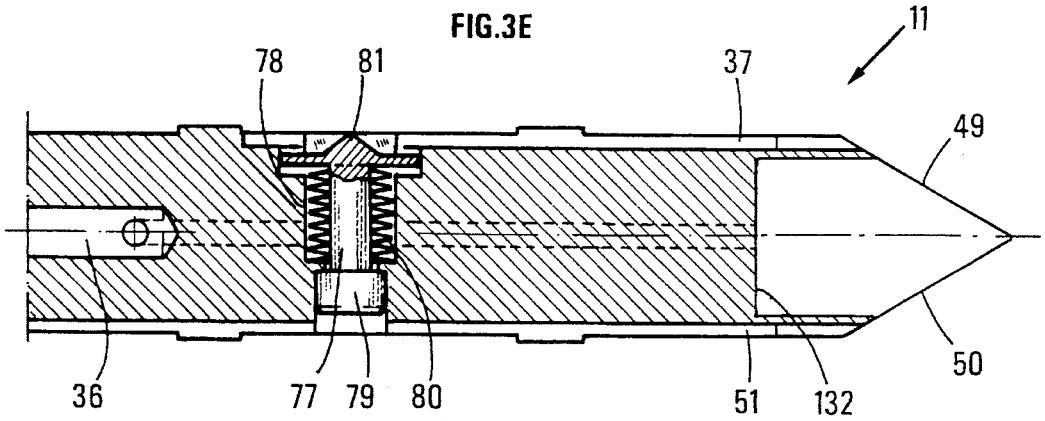
FIG. 3D and 3E illustrate another embodiment of an anchoring of the guiding device.
Figure 3D:
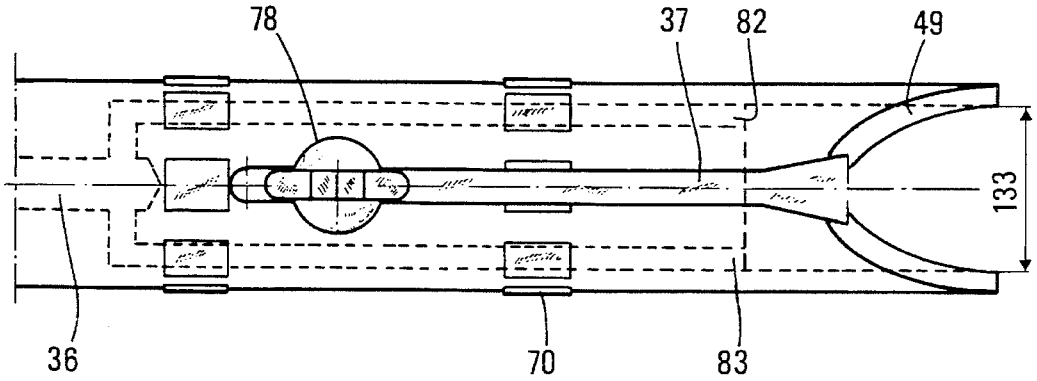

FIGS. 3D and 3E illustrate another embodiment of the means for anchoring the guide means 10 in the casing string 4. The means for orienting the guide means with respect to key 23 remain identical, as well as the lay-out of grooves 37 and 51. The reversible means for locking the key 23 in the bottom of groove 37 includes a button 77 located in a housing such as a bore 78 machined radially with respect to the guide means 23, perpendicular to the axis of groove 37. Button 77 is held by a nut 79 and it is pushed in the direction of groove 37 by a stack of Belleville type spring washers 80. The necessary force to compress the button 77 in the opposite direction, could be adjustable by number and type of spring washers. The upper shape 81 of the button 77 obstructs the groove 37, preventing displacement of the end 11 with respect to the key 23 as long as the tensile stress on the guide means 10 is not sufficient to compress the washers 80. Shape 81 advantageously slopes down towards the groove bottom and towards the opening of the groove 37.

Another mechanical feature could be constructed for this reversible locking means of guide means 10 in casing string, without departing from the scope of the invention.

In this embodiment, a conduit 36, which has the same axis as end 11, terminates before the housing 78. Conduit 36 is extended up to the end of the guide means by conduits 82 and 83 parallel to the axis of the guide means 10 and arranged on either side of housing 78 in order not to interfere with the housing 78.

In FIGS. 3E and 3D, the double-pointed end is not substantially solid, but pierced with a cylindrical hole of a diameter referenced 133 and whose bottom is referenced 132. In this variant, conduits 82 and 83 open into the bottom 132.

FIGS. 5A and 5B relate to the upper end 18 of the guide means 10. This part is preferably tubular, with an outside diameter compatible with the inside diameter of the main string and with the value D (FIG. 4B), and has an inner passageway 22 of a diameter compatible with the diameter of the lateral drill bit. Conduit 22 opens onto the inlet of the ramp 15.

The end of part 18 has the shape of a bevel 20 forming a means for guiding and orienting means 10 with respect to key 23. Groove 51 opens into the lower part of the bevel as shown in FIG. 5B. In fact, in the case where the operator takes the guide means 10 up to the surface, when key 23 forms an obstacle against bevel 20, the total guide means 10 will be brought into rotation along the slope of bevel 20, until the key 23 enters the groove 51 described above. Since groove 51 opens onto the other end of the guide means 10, the guide means 10 may be taken up towards the surface without being stopped by key or keys 23.

A slot 53 of predetermined length is cut out in the wall of the upper end 18 of the guide means 10, along the direction of a generatrix, substantially at 90° to the generatrix of the groove 51.

Inner notches 19, machined in the wall of passageway 22, allow the rods for maneuvering the guide means 10 to be hung by way of a running tool, fastened at the end of these rods. Slot 53 may co-operate with a finger integral with the running tool so that a rotating of the maneuvering rods from the surface carries the guide means 10 along in the same rotation. There may be another means for fixing the guide means 10 in rotation with respect to the running tool, notably through an adapted shape of notches 19. In order to handle and to set guide means 10, a conventional fishing tool or "releasing spear", which anchors into bore 22 by a system of wedges, is preferably used.

Figure 6B:
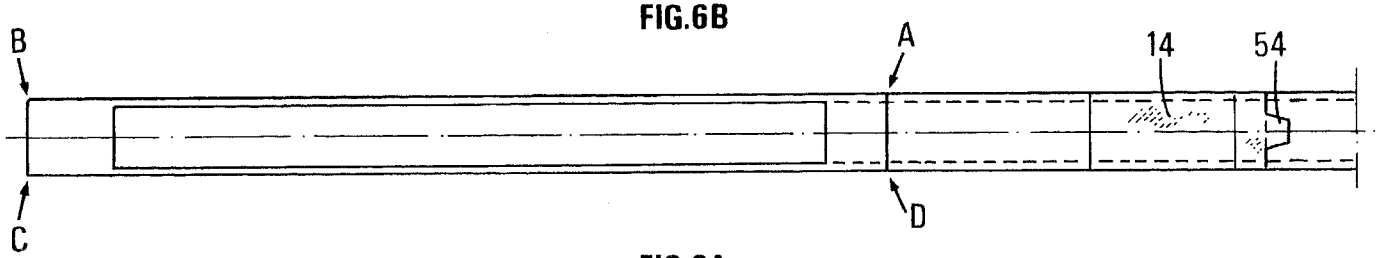
FIGS. 6A and 6B illustrate a connecting sub.
Figure 6A:
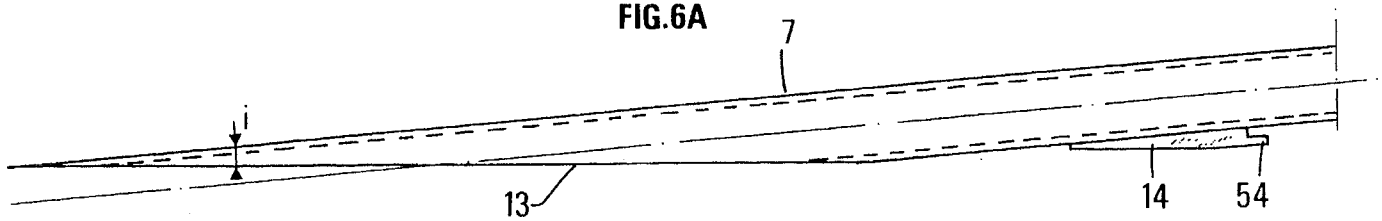
Figure 13:
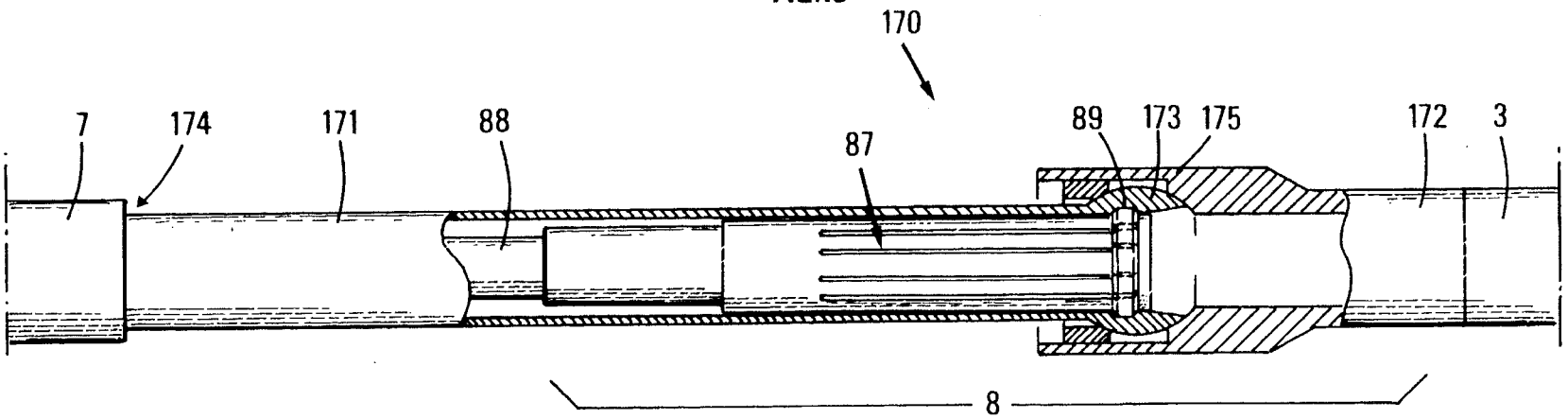
FIG. 13 is a partial cross-sectional view of a flexible and rotary joint linking the connecting sub to the pipes of the lateral casing.

FIGS. 6A and 6B, which have already been discussed above, relate to the end of lateral string 3 comprising the connecting sub 7 and an intermediate joint 8 between the pipes of string 3 and connecting sub 7. Joint 8 allows the connecting sub 7 to be oriented around the longitudinal axis of the casing string 3 with respect to the lateral opening 21, without requiring a rotation of the whole casing string 3. In fact, the length and/or the inclined lay-out of this string 3 may cause considerable friction, which should be overcome through the orienting means co-operating with the upper part 18 of the guide means 10. Joint 8 thus allows the connecting sub 7 to be uncoupled in rotation from string 3 and facilitates the orientation of said sub 7. Moreover, the flexibility of the joint 8 allows the correct inclination of the sub 7 in relation to the connecting lateral opening and the closing means. Such a joint 8, illustrated in FIG. 13, is described below.

The cross section of the connecting sub 7 preferably has a square external shape of a dimension such that it is substantially inscribed in a circle of a diameter equal to the inside diameter of conduit 22. In fact, the whole lateral casing string 3 must pass through inner passage way or conduit 22 of the upper part 18 of the guiding device 10. The inside diameter of the conduit 22 limits the outside diameter of the components of the casing string 3.

The square pipe is shaped along an orthogonal plane with two parallel faces, forming an angle i (FIG. 6A) with the longitudinal axis of the connecting sub 7. Angle i is substantially equal to the angle I (FIG. 2A) of the ramp 15, or to an angle of a tangent at the end of the ramp 15 with respect to the longitudinal axis of the main casing string 4. Thus, FIG. 6B is a bottom view of the rectangular section ABCD of the end 13 of the connecting sub 7. As described above, the periphery consisting of the sides AB-BC-CD comes close to or contacts the sliding gate 12 when the gate 12 is closed. Side DA contacts the peripheral portion of the window of the cap 16 (FIG. 4A). The peripheral contacts thus limit the clearance between the connecting sub 7 and the lateral opening 21. Of course, this shape is not all limitative of the system, but has been preferably selected to make the design and the manufacturing of the opening 21, of the gate 12 and of the connecting sub 7 easier.

A shoe 14 is welded onto the connecting sub 7 so as to constitute a dog 14 and enable a locking of the connecting sub 7 in the opening 21. The finger 54 of the shoe 14 enters the housing 55 between the cap 16 and the body of the tubular element 24 at the end of a translation of the connecting sub 7 on the slide (FIG. 4B). A mechanical hooking device, for example, an elastic hook, may be integrated between two cooperating parts, namely, the finger 54 and the housing 55. Besides, in order to complete the fixing in position of the connecting sub 7 in the opening 21, the gate 12 may comprise locking means cooperating, towards the end of the closing process, with supplementary means borne by the connecting sub near to the periphery of the side BC. These means (not shown) are understandable to the skilled artisan.

Figure 6D:
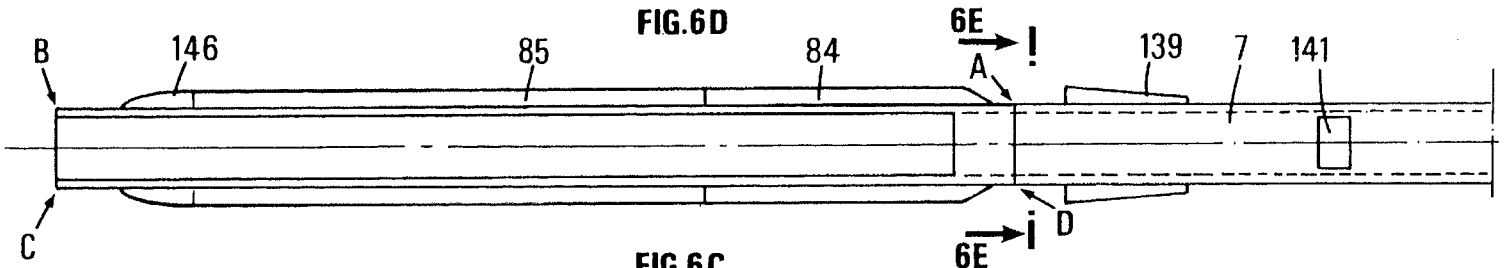
FIGS. 6C, 6D and 6E illustrate another embodiment of a connecting sub-in accordance with the present invention.
Figure 6C:
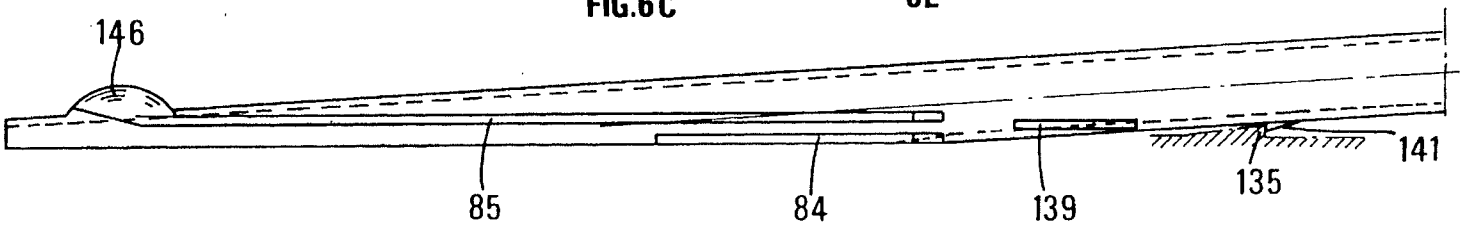
Figure 6F:
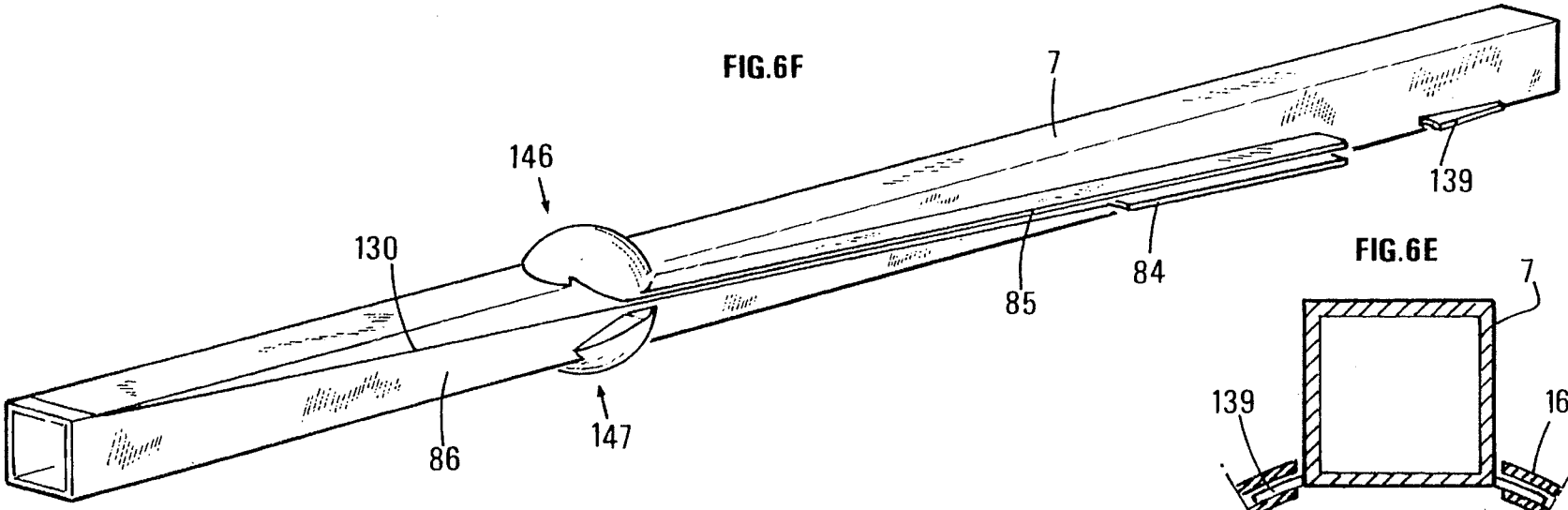
FIG. 6F is a perspective view of a connecting sub assembled to a running tool.
Figure 9A:
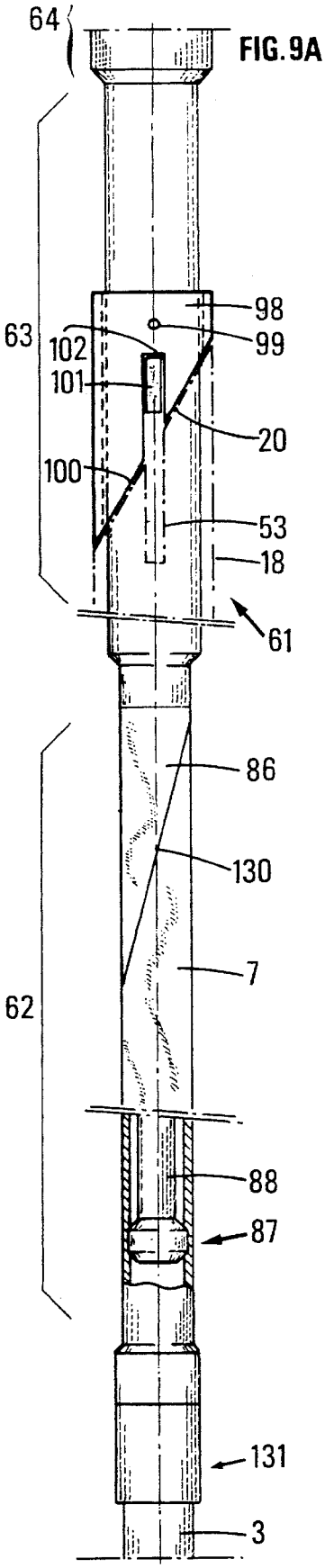
FIG. 9A is a partial cross-sectional view of a running tool for setting the lateral string.

FIGS. 6C and 6D show another embodiment of the connecting sub 7, comprising slides having portions substantially parallel to section 13. The slides consist of two rails 84 and 85 welded substantially along each side BA and CD. The space between the rails corresponds to the thickness of the branches 33 and 34 of gate 12. The lower rails 84 are shorter than the upper rails 85. The end of rails 85, on side BC, comprises a part 146 of a centering device co-operating with another part 147 connected to the holding part 86 (FIG. 9A). In FIG. 6F, the connecting sub 7 is shown in perspective and assembled with holding part 86. The centering device has substantially the shape of a truncated sphere with a V-shape on the side of the point of the connecting sub 7. This V-shape is used for guiding the branches 33 and 34 of gate 12. Part 147 is suited for placing substantially the junction plane 130 at the level of opening 21 during the setting of the lateral casing 3 string. When the gate 12 is closed, the slides hold the connecting sub 7 in position.

FIG. 6C shows another variant of a locking device between the connecting sub 7 and the body of tabular element 24. The locking device comprises a shoe 141 whose profile has the shape of an inverted tooth with respect to the shoe 135 of the tubular body 24 (FIG. 15B). The profile of part 135 is shown here so as to facilitate understanding of the co-operation of the shoes 135 and 141 which provides blocking of the connecting sub in the upward direction towards the surface. The proper position of the connecting sub 7 may be confirmed by pulling tension into the drill-string connected to the connecting sub 7, if there is a resistance, the operator may deduce that the shoe 141 is properly placed with respect to the opening 21, and, therefore, that the relative positions of the various elements are correct.

Figure 6E:
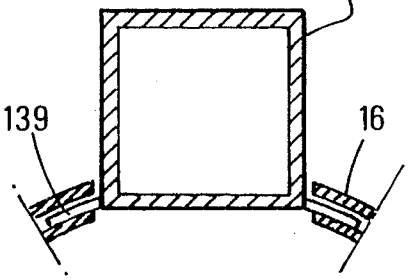

FIG. 6E is a cross-section of the connecting sub 7 close to wings 139. These wings 139 position the connecting sub 7 with respect to the tubular body 24 by being placed below cap 16 at the level of the zones 140 (FIG. 15A).

The advantages and the functions of the various elements of the system according to the invention will be clear from reading the description hereafter of operating sequences given by way of non limitative examples.

Figure 7A:
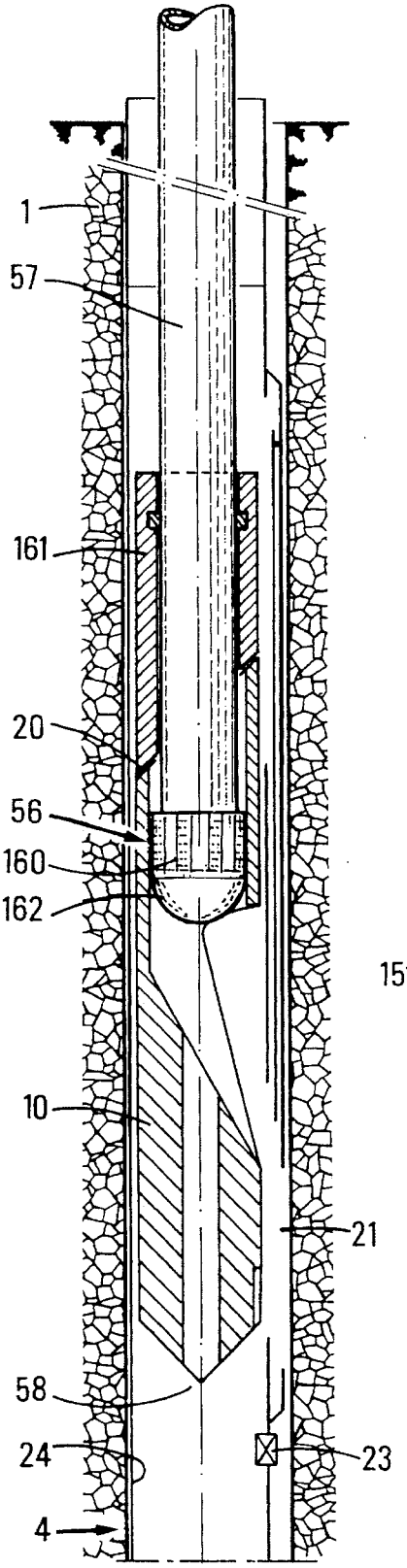
FIGS. 7A, 7B and 7C are schematic views in a main string of the guiding device, the lateral well, and the taking down of the lateral string into the lateral well, respectively.

FIG. 7A shows a main well 1 into which a casing string 4, at least a portion of which comprises a lateral opening 21, has been lowered. The completion stage of well 1 is generally similar to the conventional process of casing of a well. The casing string 4, preferably, includes pipe elements called "casing" or "tubing" according to the denomination standardized by the "American Petroleum Institute". These pipes are connected to one another through threads. The string portion comprising opening 21 is preferably made from one length of pipe so as to obtain the tubular element 24 shown in FIGS. 4A, 4B and 4C or 15A and 15C.

As casing string 4 is being lowered, the operators integrate into the casing string the tubular element or tubular elements 24 so that, at the end of the lowering operation, these tubular elements 24 are positioned at the level of the point where the lateral drillings are to be started.

In the most common case where several lateral drillings are prepared from the main well 1, elements 24 have to be oriented with respect to one another so that the direction of the openings 21 corresponds to the expectations of the draining pattern desired by the operators. The lower connection means 25 (FIGS. 4B, 15B) for Connecting tubular element 24 may comprise a specific means for setting the orientation of the tubular element 24 with respect to the lower casing string. Any means known in general mechanics may be used, for example, the screw-nut principle with a jam nut. This principle may be transposed in the present case as follows: connection 25 includes a straight pin thread; the pipe on which connection 25 is threaded comprises a corresponding box thread; a ring acting as a jam nut is mounted on the pin thread.

The attachment of the tubular element 24 is achieved at the surface on the end of the string which is already assembled and introduced in the well. The direction of the opening of the element is adjusted while mounting. This is achieved by knowing the orientation of the opening of the previous element already assembled in the main string through the setting in the string of a measuring tool at the level of this first opening. The measuring tool, for example, of the gyroscope type, is indexed with respect to the opening, for example, by the key 23. The position of the element 24 is locked by threading the ring against the end shoulder of the box thread, at a tightening torque determined by the dimension of the thread. Other fastening systems may be conceived by the knowledge of the characteristics of the connections of the "casing" or "tubing" pipes.

Figure 14:
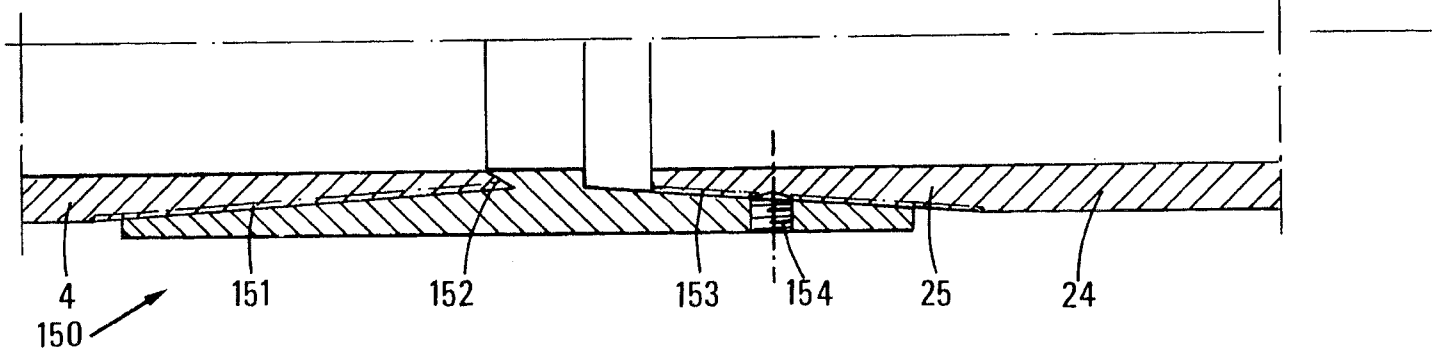
FIG. 14 is a cross-sectional view of a connecting device between a casing portion comprising an opening and a casing pipe of the main well.

FIG. 14 illustrates a simple connecting means between a tubular element 24 and a pipe of the casing string 4, a connection allowing element 24 to be adjusted and fixed in rotation. A casing collar 150 comprises two different types of box threads, 151 and 153. Thread 151 corresponds to the pin thread type of the pipes constituting the casing string 4. The connection through threads 151 comprises a shoulder 152 on which the pin end of the casing string 4 is blocked under the action of a make-up torque. A distinctive feature of this connection, conventionally called a "premium connection", is that it allows no relative rotation of the pipes with respect to one another in case a twisting moment is applied to the whole of the string. On the contrary, the connection comprising the thread 153 has no shoulder, for example, of the LTC (Long Thread Collar) type according to the 5CT standards of the American Petroleum Institute. Thus, the rotation of element 24 with respect to collar 150 may be adjusted as a function of the make-up torque applied. Orientation being achieved, lateral locking screws 154 are blocked on the outside of the pin thread 25 of element 24.

When the whole casing string 4 has been lowered into the main well, the casing string 4 is rotated around the axis thereof so as to orient all the openings 21 with respect to the producing formation. The rotating motion is achieved from the surface, either directly on the head of the string if the latter goes up to the surface, or on the maneuvering rods if the string is of the "liner" type, that is to say, if it stops at the level of the shoe of the previous cemented string.

The main string and the openings thereof are properly positioned by controlling the orientation by a conventional measuring device adapted to the type of main well concerned.

A lateral drilling stage will be started after the guide means 10 shown in FIG. 7A have been installed.

The guide means 10 are assembled at the surface onto a running tool 56, for example, by way of fastening means 19 comprising notches (FIG. 5A) and slot 53, or by way of a releasing spear comprising an alignment sub 161, spear grapples 160 and a guide sub 162. The fastening may be achieved with any other equivalent means without departing from the scope of this invention. The means are lowered into string 4 by maneuvering rods 57. Maneuvering rods must be understood as all the elements that could make a string, for instances casing, tubing, coil tubing, pumping rods, drill-pipe. The depth reached by the means is controlled by adding the lengths of rods 57. When the point 58 provided with a double slope (49, 50) abuts against key 23, point 58 guides the guide means 10, either into the anchoring position when the key enters groove 37 (FIG. 3B), or into the displacement position when the key 23 enters the groove 51 (FIG. 3C).

As it has already been described, when the guiding of the point 58 occurs in an undesirable direction, the operator takes the guide means 10 up above the key 23, as shown in FIG. 7A, then applies a half-turn rotation to rods 57 and, in the same motion; the guide means 10 now present the other guiding plane (49 or 50 in FIG. 3A) on key 23. The operator can then choose to anchor or not anchor the guide means 10 on the key 23 located at the concerned distance.

In case the anchoring is achieved at the level of the opening provided for the lateral drilling, the running tool 56 is disconnected through a controlled action from the surface. There are well-known systems which may be disconnected, for example, by rotation, mechanical jarring or by hydraulic control. The drilling operation may then be achieved as schematically shown in FIG. 7B.

In the other case, rods 57 must be added so as to reach another opening located deeper, in the direction of the bottom of the main well.

It is also possible to lower the guide means 10 and the lateral drill string 3 together into the well. The lateral drill string 3 is then fastened to the guide means 10 by a reversible locking device, for example, of the shear pin type. In this case, when guide means 10 are set in relation to the key 23, the drill string being released from the guide means 10 by shearing the pin allows the lateral drilling to be performed without any additional operation.

Figure 7B:
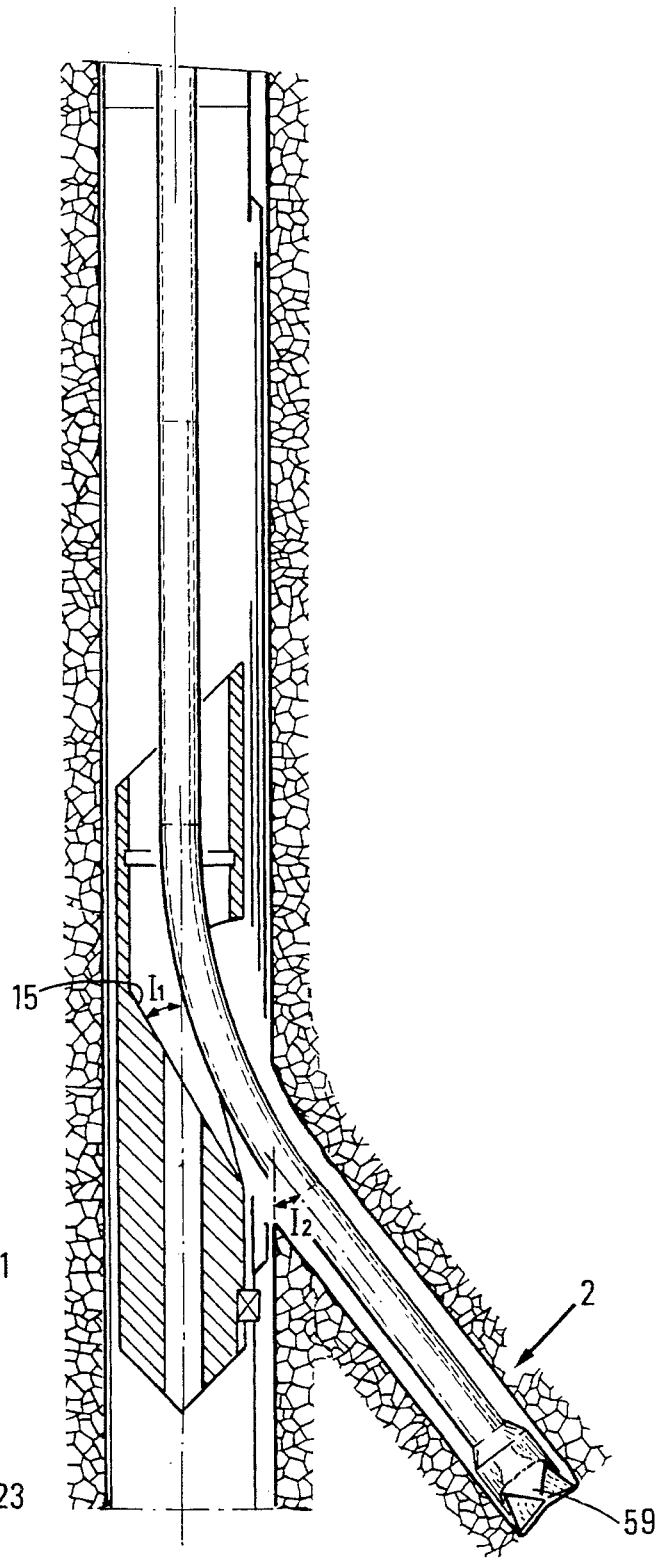

FIG. 7B shows a drill bit 59 during the drilling of the lateral well 2. The deviation angle $I_1$ between the main well and the beginning of the lateral well is substantial equal to the angle $I_2$ formed by the tangent at the surface of the ramp 15, at the lower end thereof. The surface of the ramp 15 may be planar, as shown in FIG. 2A, but preferably it will be curved so as to allow a reduction in the length of the opening 21. The temperature curvature of the ramp 15 may also have a variable angle increasing in the direction of the opening 21. Of course, the allowable curvature of the ramp 15 is limited by the stiffness of the drill string and by that of the lateral string.

Figure 7C:
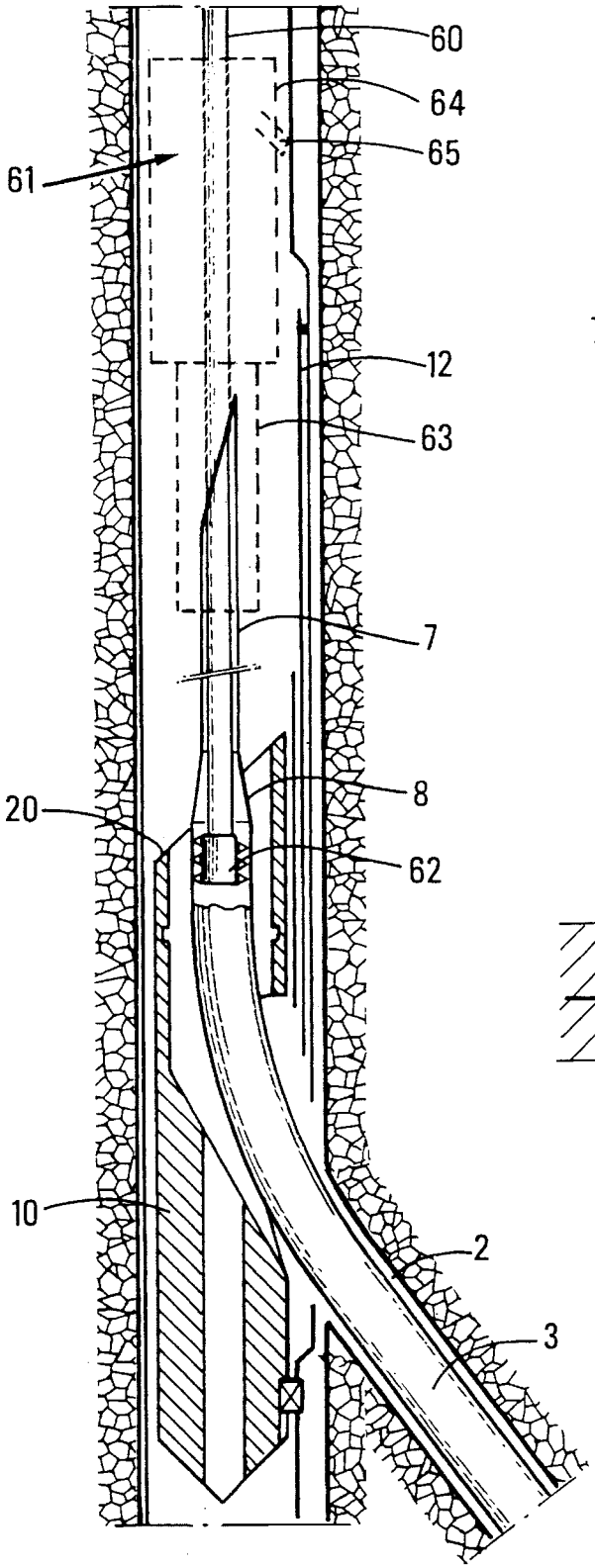

FIG. 7C relates to the introduction of the lateral casing string 3 into the lateral well 2, and illustrates the equipments being lowered, before the connecting sub 7 is set definitively at the level of the opening 21. The liner type string is ended by the connecting sub 7. The connecting sub 7 is linked to the pipes of the casing string 3 by a joint 8. The casing 3 is shown as being introduced into the lateral well 2, but the joint 8 and the connecting sub 7 are still located in the inner space of the main string 4 (FIG. 7C). The whole string is lowered by the maneuvering rods 60 going up to the surface. A running tool 61 is threadably attached substantially at the lower ends of the maneuvering rods 60. The casing string 3 is hung on the running tool 61 through the fastening means 62.

The running tool 61 is preferably adapted for achieving at least one of holding the load represented by the weight of the casing string 3; withstanding a downward thrust on the casing string 3, a thrust that is generally exerted by drill collars or heavy weight drill pipes threaded above the tool 61; controlling the anchoring thereof on a lateral string from the surface; orienting the connecting sub 7 close to the slide so as to allow the positioning thereof with respect to the opening 21, with the orienting means cooperating with the upper part 20 of the guide means 10; displacing in translation the connecting sub 7 on the ramp 15 while keeping the desired orientation; and operating the gate 12 in the closing direction around the connecting sub 7 once the connecting sub is linked to the main string 4.

The running tool may comprise anchoring means 62 on the inside of the pipes of string 3, an orientation and displacement assembly 63, an assembly 64 for operating gate 12 comprising a finger 65 adapted for co-operating with the slot 66 of the body of the tubular element 24 (FIG. 4B) so as to be positioned above the gate. Finger 65 is adapted for being displaced in translation so as to cause the gate 12 to slide in the housing thereof and to close the space between the opening and the connecting sub. The finger 65 may be actuated radially and longitudinally through a means comprised of a screw, driven into rotation through the rotation at the surface of the maneuvering rods 60, or by displacing a hydraulic jack subjected to a fluid under pressure injected from the surface.

A running tool designed from other mechanical systems may be used without departing from the scope of this invention, insofar as the purpose of the main functions, described above, is notably to implement the present system or method.

FIG. 9A shows a tool 61 for lowering and setting the lateral casing string 3. The tool is anchored in the connecting sub 7, which is integral with the casing string 3 by a swivel joint 131. The tool comprises an assembly 64 for operating gate 12, which is not shown in FIG. 9A but which is detailed in FIGS. 10A, 10B and 10C, an assembly 63 for orienting and positioning the connecting sub 7 in the opening 21, an assembly 62 for anchoring the running tool 61 in the connecting sub 7. The anchoring assembly comprises a locking means 87 integral with the end of a maneuvering pipe 88 and a part 86 holding the connecting sub 7. Holding part 86 has a face 130 complementary with respect to the section 13 of connecting sub 7. Part 86, integral with pipe 88, fixes the connecting sub 7 in rotation with respect to pipe 88 when the section 13 of the connecting sub 7 is in contact with the face 130 of the holding part. In order to increase resistance to the torque, the part of the pipe 88 located inside the connecting sub 7 may comprise longitudinal grooves in which transverse pins integral with the wall of the connecting sub 7 are entrapped.

The centering device including of the parts 146 and 147 of FIG. 6F is not shown in this figure for reasons of clarity.

Figure 9B:
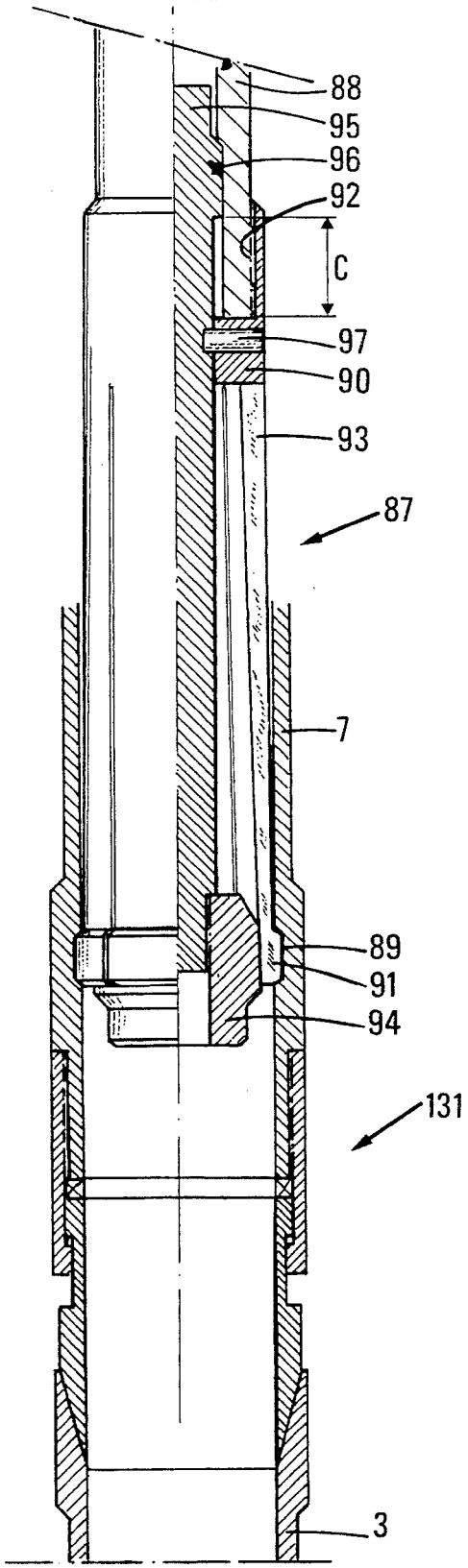
FIG. 9B is a cross-sectional view of the system for fastening the running tool in the connecting sub.

FIG. 9B illustrates an anchoring system 87. The connecting sub 7 comprises a circular groove 89 in the inner passageway thereof. A cylindrical part 90 is integral with the end of pipe 88 through a thread 92. Part 90 has several slots 93 distributed on the periphery, allowing a radial expansion of the end 91 of slotted part 90. This end is machined in a male shape, complementary with respect to groove 89. A stopper 94 widens the end 91 of slotted part 90, thereby locking pipe 88 in the connecting sub 7. Stopper 94 is integral with a piston 95 located in the bore of pipe 88. Seal means 96 isolate the inner space of pipe 88 from the annular space. A shear pin 97 makes piston 95 integral with pipe 88. The casing string 3 mounted in this fashion is lowered into the well by rods integral with pipe 88. The longitudinal stresses are supported by the co-operation of groove 89 and the shape of end 91. Unlocking will be achieved by increasing the pressure inside the pipe 88, by means of the inner space of the maneuvering rods and of a surface pumping installation. When the pressure provides a thrust on the piston 95 higher than the shear strength of pin 97, the pin 97 breaks and releases the piston which moves, under the effect of pressure, towards the bottom of the figure, by a predetermined stroke C. This translation motion of the piston releases stopper 94 out of the end of part 90. Because of the elasticity of shape 91, the latter retracts by itself or under the effect of a longitudinal force exerted on pipe 88, thus releasing pipe 88 from the connecting sub 7 and lateral casing string 3.

In FIG. 9A, orienting assembly 63 comprises a jacket 98 integral with pipe 88 through a shear pin 99. The jacket comprises a shape 100 complementary with respect to the shape of the orienting means 20 of the upper end of the guide means 10 (FIG. 2B). To facilitate understanding, the outline of the upper part 18 of the guide means 10 is shown in dotted line in FIG. 9A. A key 101, integral with pipe 88, is located in a slot 102 provided in jacket 98. At the end of the setting of the casing string 3 in the lateral well, the shape 100 of the jacket of the running tool co-operates with the orienting means 20 of the guide means 10. Co-operation directs the running tool and the connecting sub 7 into a determined direction, which is given by the orientation of the guide means 10 in conduit the casing string 4. At the end of the orientation operation, the downward displacement of the running tool and of the casing string 3 is blocked by part 18. Slot 102 is located opposite the slot 53 of the upper part 18 of the guide means 10. The operator applies a shear force onto pin 99 through the action of stems or of drill collars. The breaking of the pin releases pipe 88 from the jacket 98 and, in the same motion, the casing string moves downwards in a translation movement. In this movement, key 101 enters the slot 53. When the translation motion has completed the displacement corresponding to the length of slot 53, the connecting sub 7 is correctly positioned in the opening 21. Similarly, at the end of this last displacement, the assembly for maneuvering the gate 12 is in the operation position.

FIGS. 10A and 10B show an embodiment of an assembly 64 for operating the gate 12. FIG. 10C shows said assembly in action. The two ends 103 and 104 of the assembly 64 are respectively connected to the orienting assembly 63 and to the maneuvering string, which may comprise drill collars, heavy rods or rods. The outer body 105 of assembly 64 comprises a window 106 of elongate shape along a generatrix of body 105, an upper guide bearing 107 and a lower guide bearing 108. A longitudinally mobile assembly 109, coaxial to said outer body 105, comprises an upper piston 110, a lower piston 111, integral with a support 112 of a finger 76 for operating gate 12. Seal means 113 and 114 are located respectively in the guide bearings 107 and 108 of assembly 109 in the outer body 105. The shoulders 117 and 116 of the outer body 105 limit the displacement in translation of assembly 109 through the respective co-operation thereof with the shoulders 118 and 115 integral with support 112. A return spring 119 holds assembly 109 in an upper position with respect to the outer body 105 or open position. In this open position, shoulders 118 and 117 are in contact, as shown in FIGS. 10A and 10B. The outside diameter of the upper piston 110, or the inner diameter of seal means 113, is substantially larger than the outside diameter of the lower piston 111, or than the inner diameter of seal means 114. Assembly 109 therefore constitutes a differential piston. The pressure prevailing in the inner space of the pipes applies onto different sections, the largest section being on the side of the upper piston 110. Finger 76 is articulated around the pin 120. A leaf spring 131 (FIG. 10C) is held on body 112 by a part 122 bearing pin 120. The spring arranged below finger 76 tends to pivot the latter towards the outside of support 112. In the position called open position, shown in FIGS. 10A and 10B, the finger 76 is held retracted, parallel to the axis of tool 64, by the part 121 of the outer body 105. A tubular rod 123 is located inside the lower piston 111. Rod 123 comprises, at the lower end thereof, a shoulder 132 adapted to co-operate with a dog (not shown) located at a determined distance in the end pipe 103, and at the upper end thereof, a pack-off nipple 124. A return spring 126 holds rod 123 onto the shoulder 127 of lower piston 111. Pack-off nipple 124 comprises seal means 128 and 129 on either side of at least one port 125 pierced in the support 112.

The running of the assembly 64 for operating gate 12 is described hereafter. When the casing string 3 and its connecting sub 7 are correctly positioned and oriented by the running tool 61, key 101 abuts against the bottom of the slot 53 of the upper part of the guide means 10. Window 106 is located opposite the window 66 of the body of tubular element 24 (FIGS. 4A and 4B). The pressure is increased in the inner space of the rods and of pipe 88 through pumping means located at the surface. The inner space is obstructed by the piston 95 of anchoring means 87. Considering the differential sections of assembly 109, the latter undergoes a downward thrust proportionate to the pressure and to the differential section. For example, for outside diameters of the upper and lower pistons, respectively 3.870" (9.8298 cm) and 3.495" (8.8773 cm) and a pressure of 2000 psi (13,789 kpa), the thrust force is about 4300 lbs, that is 19,126 Newton. The force compresses spring 119 while lowering assembly 109. When the pin 120 is substantially outside the housing 121, finger 76 is radially expanded by its spring 131 (FIG. 10C). Thus, the finger 76 passes through window 106, window 66 and the end of the finger co-operates with one of the openings 75 of gate 12. The thrust force displaces the gate 12 which is therefore carried along by assembly 109 until dog 115 comes close to dog 116. At the same time, the dog 132 of rod 123 co-operates with a dog (not shown) which displaces, at the end of the displacement of assembly 109, pack-off nipple 124. In this displacement, port 125 is released and communicates the inner space of pipes 88 with the annular space of the well, causing thereby a pressure drop inside these pipes 88. Thus, the operator is informed of the end of a displacement. The operator can decrease the inner pressure so as to bring assembly 109 back to its open position under the action of return spring 119. In the upward direction, the shape of finger 76 and of opening 75 is such that this finger 76 is automatically released from this opening 75. The operator repeats the operation to make the gate move forward by successive strokes, until it is completely closed. A certain number of bores 75 is necessary for this displacement by successive strokes. After a pressure buildup in the pipes, when the operator notices no pressure drop caused by the end of stroke signal constituted by nipple 124 and rod 123, the operator may deduce that the gate 12 is completely closed. This may be confirmed by the number of closing cycles that have already been achieved.

In order to release the running tool 61 from lateral casing string 3, which is now assembled by the connecting sub 7 to the main string, it will be sufficient to raise the internal pressure high enough to break shear pin 97, and the piston 95 frees the stopper 94 of end 91, releasing the latter from groove 89 (FIG. 9B). For the safety of the operation, an emergency joint could be made up between the anchoring system 87 and pipe 88. This emergency joint is adapted to release pipe 88 from the occasionally stucked anchoring system 87, by mechanical actuation as torque, weight or tension, or by explosion as backoff operation.

FIG. 13 is a particularly advantageous variant of the intermediate joint 8 between the pipes of the lateral casing string 3 and the connecting sub 7. It comprises two tubular parts 171 and 172 connected to each other by a ball joint 170. Part 171 has a certain length (about 1 meter) and a cross-section so as to exhibit a relative flexibility. Part 171 could advantageously be in form of a bellow or a corrugated tube which exhibits a good flexibility even with a short length. One end 173 has a substantially spherical shape, the other end 174 is integral with the connecting sub 7. End 173 is held in a tubular part 175, integral with one end of part 172 and whose inner shape co-operates with the spherical shape 173 so as to constitute a ball joint 170. The other end of part 172 is connected to the pipes of the lateral string 3. A flexible swivel joint allowing axial rotation and longitudinal disalignment of the connecting sub with respect to the lateral string 3 is thus constituted. Moreover, part 172 comprises in its inner wall the shape 89 (FIG. 9B) suited for cooperating with the anchoring device 87 fastened to the end of pipe 88 located in the inner space of the various tubular parts.

Figure 11B:
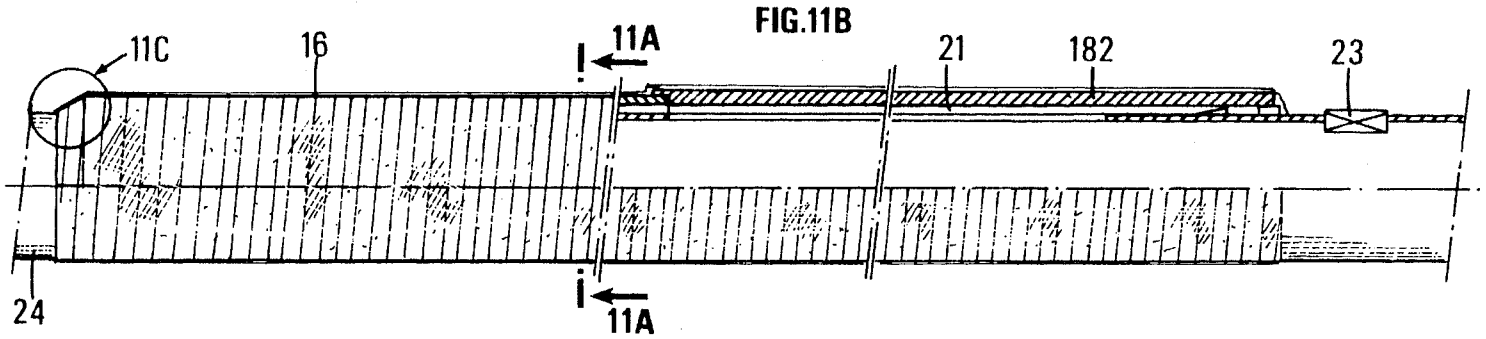
FIGS. 11A, 11B and 11C are cross-sectional views of a sealing of the casing portion comprising the at least one opening.
Figure 11A:
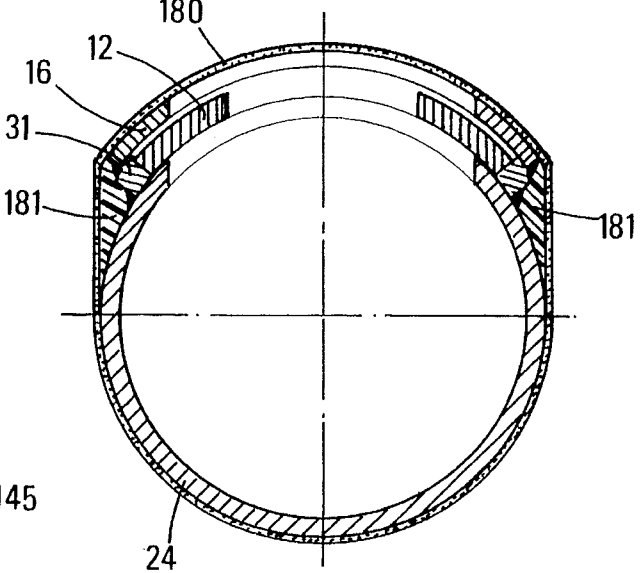
Figure 11C:
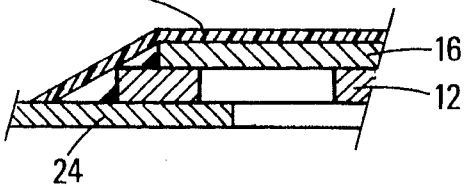

FIGS. 11A, 11B and 11C detail an example of closing of the opening 21 of tubular element 24 during the casing operation of the main well and before drilling the lateral wells from the opening 21. Bands 180 are wound around the tubular element 24 over the total length of the cap 16 by seeing to it that the coveting of the ends of the cap 16 is performed according to the detail illustrated in FIG. 11C. Moreover, in order to increase the strength of the bandage, the spaces 181 (FIG. 11A) are filled with a filler before winding. In another variant, a plate 182 made of a drillable material may seal the opening 27 (FIG. 15B) before it is covered with bands. The bands may be made from a fiber-reinforced composite material.

Figure 16A:
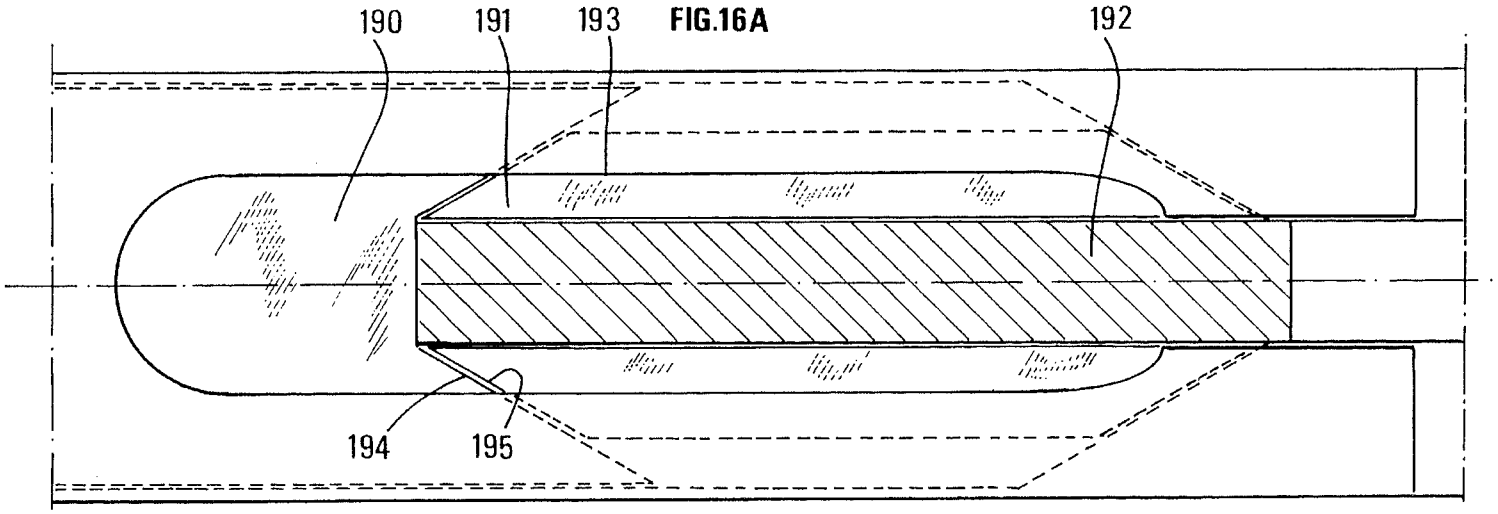
FIGS. 16A and 16B are partial cross-sectional schematic views of a variant of the sealing means in accordance with the present invention.
Figure 16B:
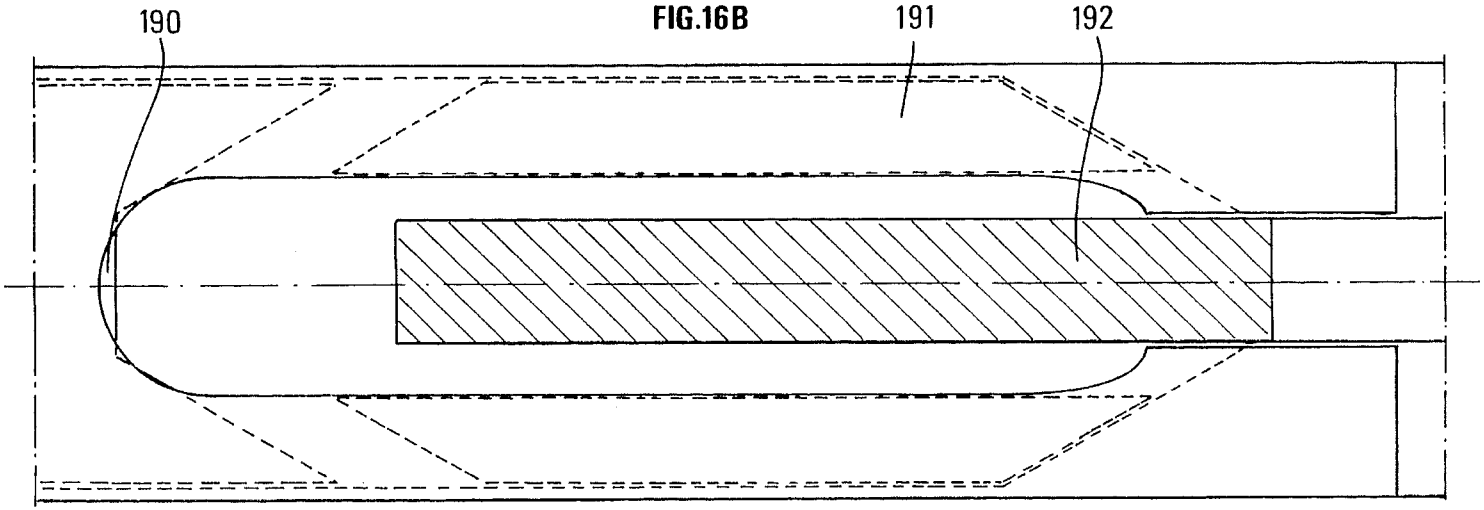

FIGS. 16A and 16B illustrate a variant of the means for closing the space contained between the connecting sub 7 and the periphery of the opening 21. The principle here is to equip element 24 with closing means in several parts 191 and 190. One part 190 slides parallel to the longitudinal axis of element 24, and two parts 191 move in rotation around this same axis. FIGS. 16A and 16B only show the working principle since the embodiment of these means is understandable to the skilled artisan, in view of the present invention.

Reference 193 relates to the opening 27 of cap 16 in top view according to FIGS. 15A or 4A. Reference 192 represents the section of the connecting sub 7 substantially in the plane of opening 27. In FIG. 16B, the opening has maximum dimensions. Lateral gates 191 are separated from each other by a distance corresponding to the width of opening 21. A longitudinal-displacement gate 190 comprises a V-shaped end 194 whose slope corresponds to the shape 195 of the lateral gates. Gates 190 and 191 are held in a housing including the body of the tubular element 24 and the cap 16. Once the lateral casing string 3 and its connecting sub 7 are set in the lateral borehole, the gate 190 is made to perform a translation to the right of FIG. 16B. The system of wedges between shapes 194 and 195 then causes the lateral gates 191 to tighten around the connecting sub 7 in a motion of rotation around the axis of the tubular element 24. FIG. 16A shows gates 190 and 191 sealing the space between the connecting sub 7 and the opening 21, after their displacements. Of course, other equivalent mechanical systems may be used to move closing elements in a given direction from a fast translation displacement.

Figure 8A:
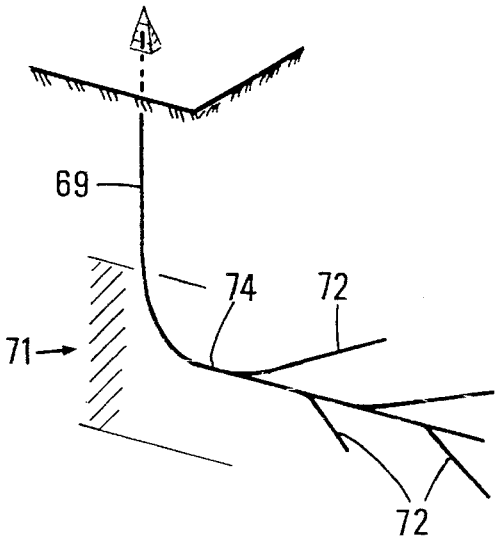
FIGS. 8A and 8B schematically illustrate preferred applications according to the present invention.
Figure 8B:
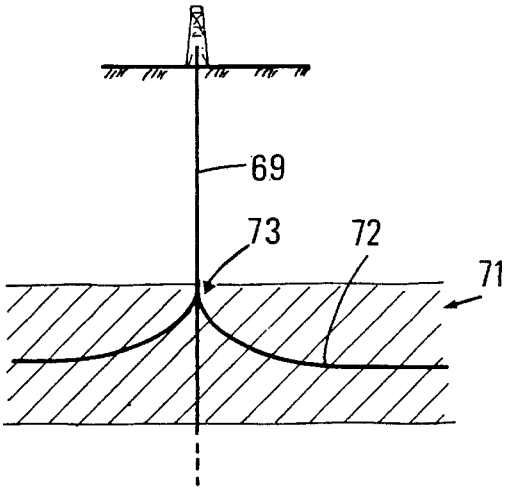

FIGS. 8A and 8B give an example of applications of the method and the system according to the invention.

In FIG. 8A, a main well 69 is drilled from the surface down to a geological zone 71, preferably a petroleum reservoir. The main well 69 extends in the producing formation 71 through a substantially horizontal part 74. Achievement of the main well is gained according to well-known techniques. Part 74 at least is cased according to the method of the invention. The casing, perforated or not, comprises at least one portion comprised of at least one lateral opening from which lateral drains 72 are drilled. The lateral drains may be substantially horizontal in the oil-bearing stratum 71, upward or downward. The lay-out of the drainage wells 72 depends on the oil-bearing stratum. The relative orientation of the openings, according to the present invention, allows the drains to be achieved in the desired directions.

In FIG. 8B, the main well 69 is substantially vertical down to the producing zone 71. The lateral wells 72 are inclined, preferably substantially horizontal in the oil-bearing stratum. The tubular portion 73 of the casing of main well 69 comprises at least one opening from which the lateral drain 72 is drilled. In order to obtain a substantially radiant drainage of the field, several openings located close to portion 73 allow several drains 72 to be drilled. The openings will be preferably located at different levels, for example for reasons of mechanical strength of the main casing or to simplify the setting of the various means used according to the system and the method of the present invention. It is possible for portion 73 not to be located in the producing formation. Besides, main well 69 may comprise several portions 73 allowing the field to be drained at levels of different depths.

The invention may also apply to the drainage of several separate oil-beating strata crossed through by main well 69. The casing of the main well comprises several portions 73 and drains 72, for example, one assembly per stratum.

In FIG. 8B, main well 69 is shown crossing totally oil-bearing stratum 71. This lay-out is not at all limitative of the scope of the invention.

We claim:

1. A method for drilling and completing lateral wells from a main cased by a main casing string comprising at least one lateral opening in the main casing string, the method comprising the steps of:

positioning a guide means in the main casing string substantially at a level of said at least one lateral opening introducing lateral drilling means through said at least one lateral opening via said guide means for drilling a lateral well extending from said main well, providing the lateral well with a lateral casing string, connecting the lateral casing string substantially on a periphery of said main casing string, and at least partially closing a space formed between said lateral casing and said at least one lateral opening by operation of a closing means.

2. A method as claimed in claim 1, wherein the step of introducing the lateral drilling means includes lowering the lateral drilling means into the main well and guiding the lateral drilling means by the guide means into said at least one lateral opening.

3. A method as claimed in claim 2, further comprising the step of guiding the lateral casing string into the lateral well by said guide means.

4. A method as claimed in claim 3, further comprising the step of orienting a means for connecting the lateral casing string to the main casing string with respect to said at least one lateral opening through said guide means.

5. A method as claimed in claim 4, wherein said space between said at least one lateral opening and the lateral casing string is substantially sealed at a level of the means for connecting.

6. A method as claimed in claim 1, further comprising the step of moving said guide means away from said at least one lateral opening after a connection of the lateral casing string to the main casing string by said means for connecting.

7. A method as claimed in claim 1, wherein the step of providing the lateral well with said lateral casing string includes introducing said lateral casing string into the lateral well by maneuvering rods assembled at a surface of the main well, said maneuvering rods being connected to said lateral casing through a running tool.

8. A method as claimed in claim 7, further comprising the step of releasing the running tool from said lateral casing string by varying a pressure in the running tool.

9. A method as claimed in claim 1, wherein said closing means are coupled to said main casing string substantially at the level of said at least one lateral opening.

10. A method as claimed in claim 1, wherein the main casing string comprises a plurality of tubular portions, each of at least two of said tubular portions including a lateral opening and each of said lateral openings being oriented in relation to one another by rotating said tubular portions around a longitudinal axis of the main string, said orientations being controlled by means of a measuring tool lowered into the interior of said main string.

11. A method for drilling and completing lateral wells from a main well cased by a casing string comprising at least one lateral opening, the method comprising the steps of:

positioning a guide means in the casing string substantially at a level of said at least one lateral opening, introducing lateral drilling means through said at least one lateral opening via said guide means for drilling a lateral well extending from said main well, providing the lateral well with a lateral casing string, guiding the lateral casing string into the lateral well by said guide means, orienting a means for connecting the lateral casing string to the casing string in the main well with respect to said at least one lateral opening through said guide means, connecting the lateral casing string substantially on a periphery of said casing string of the main well, and substantially sealing a space between said at least one lateral opening and the lateral casing string at a level of the means for connecting by activating a closing means coupled to said casing string substantially at the level of the at least one lateral opening.

12. A method as claimed in claim 11, wherein activating said closing means includes varying a pressure in the inner space of a running tool.

13. A method for drilling and completing lateral wells from a main well cased by a casing string comprising several tubular portions each including a lateral opening, the method comprising the steps of:

positioning the guide means in the casing string substantially at a level of at least one of said lateral openings, introducing lateral drilling means through said at least one of said lateral openings via said guide means for drilling a lateral well extending from said main well, providing the lateral well with a lateral casing string, connecting the lateral casing string substantially on a periphery of said casing string of the main well, orienting the respective lateral openings with respect to one another by rotating said tubular portions about an axis of the casing string, and controlling an orientation of the respective lateral openings by a measuring tool lowered into an inner space of said casing string.

14. A system for drilling and completing at least one lateral well with respect to a main well cased by a main casing string comprising at least one lateral opening, said at least one lateral opening being adapted to allow a passage of a drilling tool, the system comprising a lateral casing string arranged in said at least one lateral well, guide means positioned in the main casing string adjacent to said at least one lateral opening, means for connecting the lateral casing string to the main casing string located substantially on a periphery of the main casing string, and means for closing a space defined between said lateral casing string and said at least one lateral opening, said closing means being located substantially at the level of the connecting means.

15. A system as claimed in claim 14, wherein said guide means are adapted to guide said drilling tool and said lateral casing string into said at least one lateral well.

16. A system as claimed in claim 15, wherein the guide means comprise positioning means for allowing a repositioning of said guide means in the main casing string after the connection of the lateral string by said connection means.

17. A system as claimed in claim 16, comprising a key integrally formed with the main string at a position near said at least one lateral opening, wherein said positioning means includes a continuous groove provided along the guide means, an anchoring means including a further groove provided along the guide means, and a reversible lock fixing the key of said main casing string in said further groove.

18. A system as claimed in claim 14, further comprising a running tool for positioning said lateral casing string, said running tool being linked to the lateral casing string through a reversible anchor, said running tool comprising means for orienting the connecting means cooperating with the guide means and means for activating the closing means, said running tool being lowered into the main well by maneuvering rods.

19. A system as claimed in claim 18, wherein means are provided for activating said closing means, said activation means comprise a differential piston and a finger for displacing said closing means upon activation.

20. A connecting device for linking two casing elements together, wherein a first casing element includes a lateral opening dimensioned so as to allow passage of a second casing element, said second casing element being adapted to extend laterally from the first casing element after passage through the first casing element, said device comprising a means, disposed on a periphery of the first casing element, for linking the second casing element to the first casing element and means for closing a space formed between the laterally extending second casing element and the lateral opening.

21. A device as claimed in claim 20, wherein said means for linking comprise a connecting sub secured with the second casing element by at least one of a flexible joint or rotary joint.

22. A device as claimed in claim 21, wherein an end of the connecting sub comprises a section along an inclined plane with respect to a main axis of the connecting sub, a portion of a periphery of said section is in contact with a corresponding portion of a periphery of the lateral opening, and wherein the means for closing comprises at least one sliding plate adapted to substantially seal the space located between other portions of the periphery of said section and of the lateral opening.

23. A device as claimed in claim 22, wherein said section has a rectangular cross-sectional configuration.

24. A device as claimed in claim 23, wherein an end of said connecting sub comprises, on sides substantially parallel to the axis of the first casing element, linking means cooperating with the at least one sliding plate when the at least one sliding plate is displaced to close said space.

25. A device as claimed in claim 22, wherein the closing means comprises three sliding plates displaceable to close said space, two of said sliding plates being displaced by a translational movement of the third sliding plate.

26. A method as claimed in claim 21, wherein said flexible or rotary joint comprises a corrugated tubular part.

27. A system for drilling and completing a well extending laterally with respect to a main well, the system comprising a casing string in the main well, said casing string having at least one tubular portion provided with a lateral opening, and means for at least partially closing the lateral opening.

28. A system as claimed in claim 27, further comprising guide means adapted to enter said casing string and to guide a tool from an inside of said casing string through said guide means towards said lateral opening.

29. A system as claimed in claim 28, further comprising means for positioning said guide means with respect to the lateral opening, said positioning means being operated from a surface of the main well.

30. A system as claimed in claim 30, wherein an assembly of rods are provided for displacing said guide means in the interior of said casing string, said guide means comprising a slide inclined with respect to a longitudinal axis of the casing string and said positioning means comprise means for reversibly anchoring said guide means in the casing string.

31. A system as claimed in one of claims 29 or 30, wherein said positioning means comprises a key immovably fastened in at least one tubular portion of said main casing, said guide means comprising two grooves adapted to cooperate with said key, a first groove comprising a dog for locking the guide means on the key, and a second groove extending over a total length of the guide means.

32. A system as claimed in claim 31, wherein said guide means comprise means for engaging said key into one or the other of the two grooves, said engaging means being controlled from the surface of the main well.

33. A system as claimed in claim 32, wherein the engaging means comprise a substantially cylindrical portion having an outside diameter less than an inside diameter of said at least one tubular portion, an end of said cylindrical portion terminating in a point formed by two planes symmetrical with respect to a plane passing through the longitudinal axis and a secant along a straight line orthogonal with respect to the longitudinal axis, and each one of the grooves opens into a face of said point, symmetrically with respect to the longitudinal axis.

34. A system as claimed in claim 33, wherein the guide means comprise means for connecting rods adapted to displace said guide means in said casing string, said means for connecting rods being adapted to release the rods when the guide means is positioned in said at least one tubular portion.

35. A system as claimed in one of claims 28 or 29, comprising means for reversibly anchoring the guide means within said casing string, said anchoring means being adapted to achieve anchoring of the guide means, displaced from the surface of the main well towards a bottom of the main well, when the guide means are oriented in a first position with respect to the longitudinal axis of the casing string, and not to achieve anchoring when the guide means are oriented in a second position with respect to the longitudinal axis of the casing string.

36. A system as claimed in claim 27, wherein said means for at least partially closing said lateral opening is adapted to be operated from the surface of the main well by maneuvering rods.

37. A system as claimed in claim 36, comprising a tubular device passing through said opening, wherein the means for at least partially closing comprise sealing means adapted for substantially isolating an interior of said casing string from an annular space between the casing string and the main well.

38. A system as claimed in claim 37, wherein said sealing means comprise complimentary configurations between said means for at least partially closing, the end of said tubular device and said opening, said configurations cooperating with one another.

39. A system as claimed in claim 38, wherein said tubular device comprises a lateral casing string adapted to extend into the lateral well, and a sub for connecting said lateral casing string to said at least one tubular portion of said main casing.

40. A system as claimed in claim 39, wherein the connecting sub comprises hooking means adapted to be engaged through a translational movement of said connecting sub on a slide of the guide means, a portion of a periphery of the lateral opening is in contact with a portion of a periphery of an end of the connecting sub, thereby limiting a space between the corresponding portions, and the means for at least partially closing comprise a gate adapted for substantially closing a space between the opening and said connecting sub.

41. A system as claimed in claim 40, wherein said periphery of the end of said connecting sub is rectangularly shaped.

42. A system as claimed in claim 39, wherein said connecting sub is connected to the lateral casing string by at least one of a flexible or rotary joint, said system further comprises a running tool for setting the lateral casing string in the lateral wall, said running tool cooperates with means for orienting said connecting sub with respect to the lateral opening, and wherein said orienting means cooperates with said guide means.

43. A system as claimed in claim 42, wherein the running tool is fastened to a lower end of an assembly of maneuvering rods, and said running tool comprises means for displacing said gate so as to close a space between said opening and said connecting sub.

44. A system as claimed in one of claims 42 or 43, wherein said running tool comprises means for displacing said gate, said displacing means being actuated by hydraulic pressure generated from a surface of the main well.

45. A method as claimed in claim 42, wherein said flexible or rotary joint comprises a corrugated tubular part.

46. A system as claimed in claim 27, wherein said lateral opening is closed by a closure adapted to be destroyed by a lateral drilling tool.

47. A system as claimed in claim 46, wherein said closure comprises composite material.

48. The system as claimed in claim 47, wherein said composite material comprises reinforcing fibers embedded in a matrix.

49. A system as claimed in claim 48, wherein a plate of drillable material is placed over the lateral opening before winding bands of the fiber reinforced composite material around said casing string in the main well.

50. A method for drilling and completing lateral wells from a main well cased by a casing string, the method comprising the steps of:

outfitting the main well with a casing string having at least one tubular portion comprising at least one lateral opening, orienting a direction of said at least one lateral opening by applying a rotation to said casing string from a surface of the main well, and controlling the direction of said at least one opening by a measuring tool.

51. A method as claimed in claim 50, further comprising the steps of:

positioning a guide means in the casing string substantially at a level of the at least one lateral opening, assembling a drill string and lowering the assembled drill string into the casing string, and drilling a lateral well from said at least one lateral opening with a drill bit guided by said guide means.

52. A method as claimed in claim 51, wherein the step of positioning said guide means include displacing said guide means in the casing string through an assembly of maneuvering rods extending from a of the main well, and controlling an anchoring of said guide means by the assembly of maneuvering rods from the surface.

53. A method as claimed in claim 52, wherein, when no anchoring is achieved during displacement of said guide means on either side of the at least one lateral opening, said guide means are raised by a determined height, rotated substantially 180° , and said guide means are lowered again into the casing string so as to be anchored.

54. A method as claimed in claim 52, wherein, when said guide means are anchored subsequent to the displacement thereof, a tractive force is exerted on the assembly of maneuvering rods so as to unlock an anchoring means, said guide means are raised above the at least one lateral opening and rotated substantially 180° so as to displace said guide means towards another lateral opening located at a position further from the surface of the main well.

55. A method as claimed in claim 52, wherein after anchoring said guide means, the assembly of maneuvering rods are raised and removed from the casing string.

56. A method as claimed in claim 51, further comprising equipping the lateral well with a lateral casing string comprising at an upper end thereof a connecting sub the lateral casing string to the casing string of the main well.

57. A method as claimed in claim 56, wherein the lateral casing string is guided in the lateral well by the guide means, the lateral casing string is lowered into the well by an assembly of maneuvering rods, and a running tool is fastened to a lower end of the assembly of maneuvering rods.

58. A method as claimed in claim 56, wherein, when said connecting sub is oriented in the lateral opening, said connecting sub is locked close to the lateral opening after said connecting sub is guided by the guide means, and a space between the lateral opening and the connecting sub is substantially closed.

59. A method as claimed in claim 58, comprising a gate displaceable so as to close said space.

60. A method as claimed in claim 59, wherein said gate is displaced by injecting a fluid under pressure at the level of the running-tool.

61. A method as claimed in claim 50, wherein said casing string comprises at least two tubular portions each comprising at least one lateral opening, further comprising the steps of:

orienting the respective lateral openings with respect to one another through rotation of said at least two tubular portions about the axis of the casing string, and controlling the orientation by a measuring tool lowered into said casing string.

* * * * *